US011006696B2

(12) United States Patent
Cross et al.

(10) Patent No.: US 11,006,696 B2
(45) Date of Patent: May 18, 2021

(54) FOOTWEAR WITH SOLES HAVING AUXETIC STRUCTURES

(71) Applicant: NIKE, Inc., Beaverton, OR (US)

(72) Inventors: Tory M. Cross, Portland, OR (US); Bryan N. Farris, North Plains, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 180 days.

(21) Appl. No.: 15/604,865

(22) Filed: May 25, 2017

(65) Prior Publication Data

US 2018/0338572 A1 Nov. 29, 2018

(51) Int. Cl.

| | |
|---|---|
| ***A43B 13/18*** | (2006.01) |
| ***A43B 13/12*** | (2006.01) |
| ***A43B 13/16*** | (2006.01) |
| ***A43B 3/00*** | (2006.01) |
| ***A43B 13/04*** | (2006.01) |
| ***A43B 13/14*** | (2006.01) |
| *A43B 13/20* | (2006.01) |
| *A43B 5/02* | (2006.01) |
| *A43B 13/00* | (2006.01) |

(Continued)

(52) U.S. Cl.

CPC ..... *A43B 13/186* (2013.01); *A43B 3/0073* (2013.01); *A43B 13/04* (2013.01); *A43B 13/122* (2013.01); *A43B 13/125* (2013.01); *A43B 13/141* (2013.01); *A43B 13/16* (2013.01); *A43B 13/188* (2013.01); *A43B 3/0036* (2013.01); *A43B 5/02* (2013.01); *A43B 5/06* (2013.01); *A43B 5/10* (2013.01); *A43B 13/00* (2013.01); *A43B 13/187* (2013.01); *A43B 13/189* (2013.01); *A43B 13/20* (2013.01)

(58) Field of Classification Search

CPC ..... A43B 13/186; A43B 13/04; A43B 13/122; A43B 13/125; A43B 13/141; A43B 13/16; A43B 13/188; A43B 13/00; A43B 13/187; A43B 13/189; A43B 13/20; A43B 3/0073; A43B 3/0036; A43B 5/02; A43B 5/06; A43B 5/10

USPC ..... 36/28

See application file for complete search history.

(56) References Cited

U.S. PATENT DOCUMENTS 2,885,797 A * 5/1959 Chrencik ..... A43B 13/186 36/104
4,364,188 A * 12/1982 Turner ..... A43B 5/06 36/129

(Continued)

FOREIGN PATENT DOCUMENTS

CA 2980494 A1 12/2016
CN 105324049 A 2/2016

(Continued)

*Primary Examiner* — Alissa J Tompkins
*Assistant Examiner* — Dakota Marin
(74) *Attorney, Agent, or Firm* — Quinn IP Law

(57) ABSTRACT

A sole structure for an article of footwear can include provisions for providing auxetic behavior in the sole structure. The sole structure can comprise multiple layers that may each have different types of auxetic material. The outsole can include at least one auxetic portion joined to one non-auxetic portion. Similarly, the midsole can include at least one auxetic portion joined to one non-auxetic portion. Apertures formed in the auxetic portions of the outsole can extend through at least part of the midsole.

18 Claims, 13 Drawing Sheets

(51) Int. Cl.
*A43B 5/10* (2006.01)
*A43B 5/06* (2006.01)

(56) References Cited

U.S. PATENT DOCUMENTS 4,398,357 A * 8/1983 Batra ..... A43B 13/16 36/129
6,178,662 B1 * 1/2001 Legatzke ..... A43B 1/0009 36/29
7,124,520 B2 * 10/2006 Galbraith ..... A43B 7/144 36/43
7,146,752 B2 * 12/2006 Pasternak ..... A43B 3/0052 36/59 R
7,774,954 B2 * 8/2010 Hoffer ..... A43B 1/0009 36/28
9,775,407 B2 * 10/2017 Greene ..... B29D 35/122
2007/0213838 A1 9/2007 Hengelmolen
2008/0196272 A1 * 8/2008 Hay ..... A43B 7/1415 36/88
2009/0300942 A1 * 12/2009 Peikert ..... D04H 1/485 36/88
2012/0021167 A1 1/2012 Plant
2013/0284732 A1 10/2013 Van Schaftingen
2014/0109286 A1 4/2014 Blakely et al.
2014/0276995 A1 9/2014 Lau et al.
2015/0237958 A1 * 8/2015 Cross ..... A43B 13/181 36/103
2015/0245683 A1 * 9/2015 Cross ..... B32B 27/065 36/103
2015/0245685 A1 * 9/2015 Cross ..... A43B 13/187 36/104
2015/0245686 A1 * 9/2015 Cross ..... A43B 13/02 36/29
2016/0058121 A1 * 3/2016 Langvin ..... A43B 5/06 36/103
2016/0095385 A1 4/2016 Nordstrom
2016/0345664 A1 12/2016 Kohatsu et al.

FOREIGN PATENT DOCUMENTS

CN 105451588 A 3/2016
CN 205233606 U 5/2016
WO 2016053443 A1 4/2016
WO 2016144410 A1 9/2016

* cited by examiner

FOOTWEAR WITH SOLES HAVING AUXETIC STRUCTURES

BACKGROUND

The present disclosure relates generally to articles of footwear that may be used for athletic or recreational activities. Articles of footwear can generally be described as having two primary elements, an upper for enclosing the wearer's foot, and a sole structure attached to the upper. The upper generally extends over the toe and instep areas of the foot, along the medial and lateral sides of the foot and around the back of the heel. The upper generally includes an ankle opening to allow a wearer to insert the wearer's foot into the article of footwear. The upper may incorporate a fastening system, such as a lacing system, a hook-and-loop system, or other system for fastening the upper over a wearer's foot. The upper may also include a tongue that extends under the fastening system to enhance adjustability of the upper and increase the comfort of the footwear.

The sole structure is attached to a lower portion of the upper and is positioned between the upper and the ground. Generally, the sole structure may include an insole, a midsole, and an outsole. The insole is in close contact with the wearer's foot or sock, and provides a comfortable feel to the sole of the wearer's foot. The midsole generally attenuates impact or other stresses due to ground forces as the wearer is walking, running, jumping, or engaging in other activities. The outsole may be made of a durable and wear-resistant material, and it may carry a tread pattern to provide traction against the ground or playing surface. For some activities, the outsole may also use cleats, spikes, or other protrusions to engage the ground or playing surface and thus provide additional traction.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
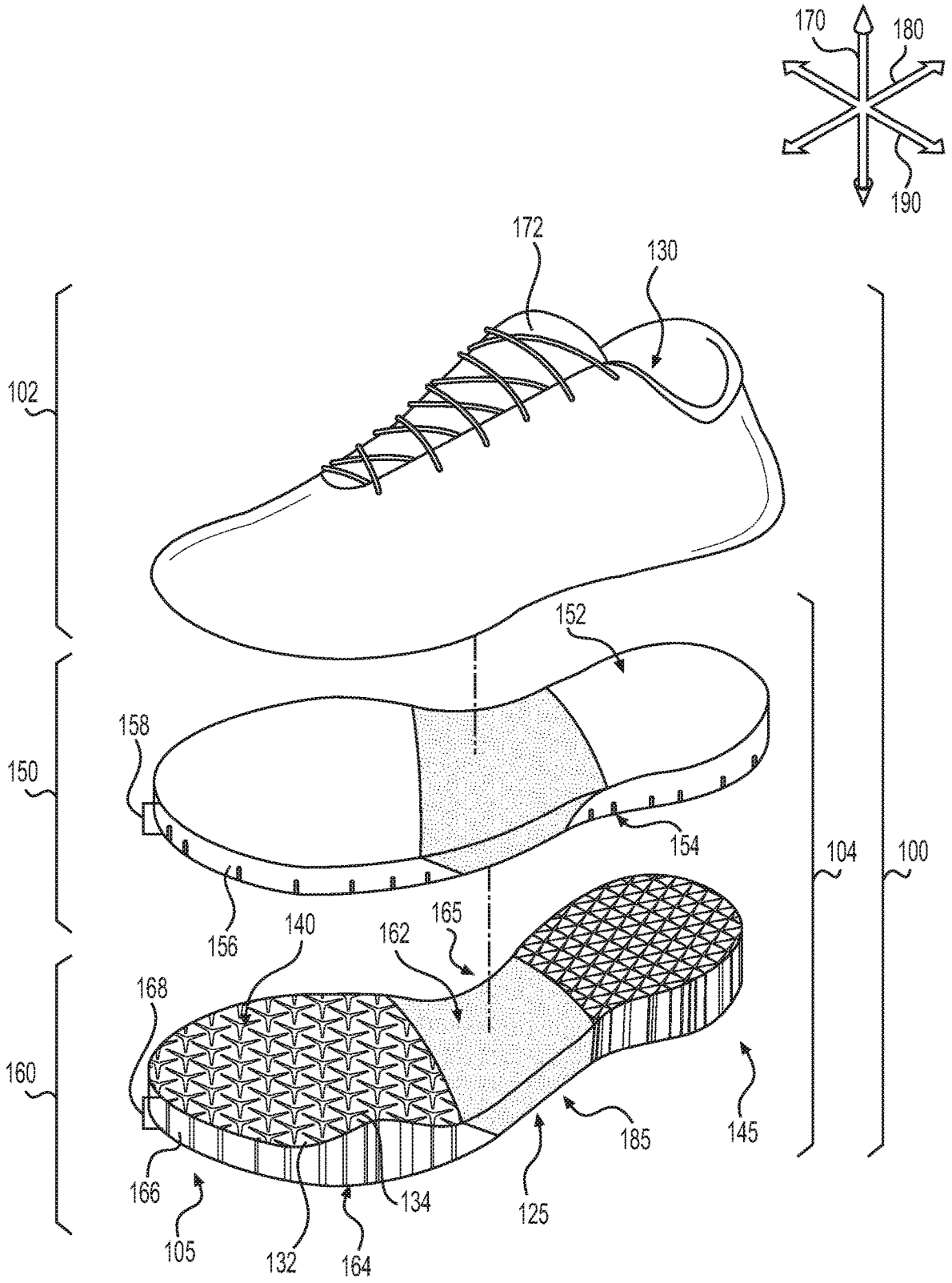
FIG. 1 is an exploded view of an embodiment of an article of footwear.

The present disclosure describes a sole structure including an outsole. The sole structure includes a forefoot region, a midfoot region, and a heel region. The heel region has a greater thickness than the forefoot region. Further, the heel region of the sole structure includes a first subset of auxetic apertures. Each auxetic aperture in the first subset of auxetic apertures extends through the outsole. The auxetic apertures of the first subset are arranged in substantially the same orientation. As a non-limiting example, all the auxetic apertures of the first subset are arranged in substantially the same orientation. The forefoot region includes a second subset of auxetic apertures. Each auxetic aperture in the second subset of auxetic apertures extends through the outsole. The auxetic aperture of the second subset of auxetic apertures are arranged in substantially the same orientation. As a non-limiting example, all the auxetic aperture of the second subset of auxetic apertures are arranged in substantially the same orientation. The orientation of the first subset of auxetic apertures is different than the orientation of the second subset of auxetic apertures. The article of footwear may be tuned using auxetic structures. With the auxetic structures, the ride, fit, and cushioning across the sole structure can be customized. Such customization is generally not possible when using a monolithic rubber or foam sole. The heel region is configured to absorb energy, while providing lateral stability. The midfoot region can be stiffer than the heel region and/or non-auxetic, because the foot exerts very little contact pressure at the midfoot portion when compared with the heel region. The forefoot region has enough firmness and structure to enable a good/firm push-off without needing to dig out of a mushy cushion. By manufacturing the presently disclosed sole structure, the heel and forefoot respond throughout a running stride can be customized, which is something that a monolithic sheet of rubber cannot do. Changing the orientation and depth of the apertures can alter how much the sole structure splays in different directions. For example, it may be desirable to provide extra heel cushioning, while also providing lateral heel support (since most people impact on the lateral side of the heel). Then, the midsole might be stiff, and the forefoot may have a different response.

According to an aspect of the present disclosure, the sole structure further includes a midsole coupled to the outsole. Each auxetic aperture in the first subset of auxetic apertures may extend at least partially into the midsole. Each auxetic aperture in the second subset of auxetic apertures may extend at least partially into the midsole, the first subset of auxetic apertures include a first aperture. The first aperture may have an aperture area in a substantially horizontal plane, and the aperture area changes in response to a compressive force.

According to an aspect of the present disclosure, each auxetic aperture of the sole structure may be surrounded by a plurality of auxetic members. Each auxetic member may be joined to a neighboring auxetic member by a hinge portion. The width of a first hinge portion in the forefoot region is greater than the width of a second hinge portion in the heel region. The first aperture is a through-hole aperture.

According to an aspect of the present disclosure, the first aperture comprises a substantially tri-star shape. As a non-limiting example, the first aperture may have a simple isotoxal star-shaped polygonal shape.

According to an aspect of the present disclosure, the sole structure is deformable between a first configuration and a second configuration, and the aperture area of the first aperture is larger in the second configuration relative to the first configuration.

According to an aspect of the present disclosure, the sole structure is configured to deform from the first configuration to the second configuration upon application of tension to the sole structure.

According to an aspect of the present disclosure, the sole structure includes a first sole member and a second sole member. The first sole member is disposed beneath and adjacent to the second sole member. The sole structure includes a forefoot region, a midfoot region, and a heel region. The heel region includes a first subset of auxetic apertures. Each auxetic aperture in the first subset of auxetic apertures extends through the thickness of the first sole member. As a non-limiting example, each auxetic aperture in the first subset of auxetic apertures extends through the entire thickness of the first sole member. The first subset of auxetic apertures are arranged in substantially the same orientation. The forefoot region includes a second subset of auxetic apertures. Each auxetic aperture in the second subset of auxetic apertures extends through the thickness of the first sole member. As a non-limiting example, each auxetic aperture in the second subset of auxetic apertures extends through the entire thickness of the first sole member. The auxetic apertures of the second subset of auxetic apertures are arranged in substantially the same orientation. At least one auxetic aperture of the first subset of auxetic apertures is filled with a first material. As a non-limiting example, at least one of the auxetic aperture of the first subset of auxetic apertures is entirely filled with the first material. The first sole member comprises a second material. The first material is more elastic than the second material.

According to an aspect of the present disclosure, the first sole member has a greater thickness in the heel region than in the forefoot region, the heel region includes a third subset of auxetic apertures. Each auxetic aperture in the third subset of auxetic apertures extends at least partially through the thickness of the second sole member.

According to an aspect of the present disclosure, the auxetic apertures of the third subset of auxetic apertures are arranged in substantially the same orientation as the first subset of auxetic apertures. Each auxetic aperture in the third subset of auxetic apertures is aligned in a substantially vertical direction with a corresponding auxetic aperture in the first subset of auxetic apertures.

According to an aspect of the present disclosure, the forefoot region includes a third subset of auxetic apertures. Each auxetic aperture in the third subset of auxetic apertures extends at least partially through the thickness of the second sole member.

According to an aspect of the present disclosure, the third subset of auxetic apertures are arranged in substantially the same orientation as the second subset of auxetic apertures. Each auxetic aperture in the third subset of apertures align in a vertical direction with a corresponding auxetic aperture in the second subset of auxetic apertures.

According to an aspect of the present disclosure, the third subset of auxetic apertures are arranged in substantially the same orientation as the first subset of auxetic apertures.

According to an aspect of the present disclosure, each auxetic aperture of the third subset of auxetic apertures is a through-hole aperture.

According to an aspect of the present disclosure, the orientation of the first subset of auxetic apertures is different than the orientation of the second subset of auxetic apertures.

According to an aspect of the present disclosure, each auxetic aperture of the sole structure is surrounded by a plurality of auxetic members. Each auxetic member is joined to a neighboring auxetic member by a hinge portion. The width of a first hinge portion in the forefoot region is greater than a width of a second hinge portion in the heel region.

According to an aspect of the present disclosure, a sole structure includes a first sole member. The sole structure includes a forefoot region, a midfoot region, and a heel region. The heel region includes a first subset of auxetic apertures. Each auxetic aperture in the first subset of auxetic apertures extends through the thickness of the first sole member. The first subset of auxetic apertures are arranged in substantially the same orientation. The forefoot region includes a substantially smooth intermediate portion. The intermediate portion comprises a non-auxetic material.

According to an aspect of the present disclosure, the sole structure further includes a second sole member disposed beneath and adjacent the first sole member. The first sole member may be attached to the second sole member to produce the sole structure. The second sole member includes a second subset of auxetic apertures in the heel region. Each auxetic aperture in the second subset of auxetic apertures may be arranged in substantially the same orientation.

The orientation of the second subset of auxetic apertures in the second sole member may be substantially similar to the orientation of the first subset of auxetic apertures in the first sole member. Each auxetic aperture in the second subset of apertures may be aligned in a vertical direction with a corresponding auxetic aperture in the first subset of auxetic apertures.

According to an aspect of the present disclosure, the first aperture of the first subset of auxetic apertures in the first sole member may be filled with a material that is more elastic than the material comprising surrounding the first aperture.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or upper. Thus, the terms proximal and distal may be understood to provide generally opposing terms to describe the relative spatial position of a footwear layer.

Furthermore, throughout the following description, the various layers or components of a sole structure may be described with reference to a proximal side and a distal side. In embodiments in which the upper and/or the sole structure comprise multiple layers or components (as will be discussed further below), the proximal side will refer to the surface or side of the specified layer that faces toward the upper and/or faces toward the foot-receiving interior cavity formed in the article. In addition, the distal side will refer to a side of the layer that is opposite to the proximal side of the layer. In some cases, the distal side of a layer is associated with the outermost surface or side. Thus, a proximal side may be a side of a layer of the sole structure that is configured to face upward, toward a foot or a portion of an upper. A distal side may be a surface side of a layer of the sole structure that is configured to face toward a ground surface during use of the article.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

FIG. 1 depicts an isometric exploded view of an article of footwear ("article") that includes an upper 102 and a sole structure 104. In the current embodiment, article 100 is shown in the form of an athletic shoe, such as a running shoe. However, in other embodiments, sole structure 104 and components of sole structure 104 described herein may be used with any other kind of footwear including, but not limited to, hiking boots, soccer shoes, football shoes, sneakers, running shoes, cross-training shoes, rugby shoes, basketball shoes, baseball shoes as well as other kinds of shoes. Moreover, in some embodiments, article 100 may be configured for use with various kinds of non-sports-related footwear, including, but not limited to, slippers, sandals, high-heeled footwear, loafers as well as any other kinds of footwear.

As noted above, for consistency and convenience, directional adjectives are employed throughout this detailed description. Article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100 but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

As noted above, article 100 may include upper 102 and sole structure 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

As shown in FIG. 1, upper 102 may include one or more material elements (for example, meshes, textiles, foam, leather, and synthetic leather), which may be joined to define an interior void configured to receive a foot of a wearer. The material elements may be selected and arranged to impart properties such as light weight, durability, air permeability, wear resistance, flexibility, and comfort. Upper 102 may define an opening 130 through which a foot of a wearer may be received into the interior void.

At least a portion of sole structure 104 may be fixedly attached to upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

The term "sole structure," also referred to simply as "sole," herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer covering, an outsole, a midsole and/or an inner sole. In an exemplary embodiment, sole structure 104 comprises a midsole as well as an outer sole structure configured for contact with a ground surface.

In some embodiments, sole structure 104 may be configured to provide traction for article 100. In addition to providing traction, sole structure 104 may attenuate ground reaction forces when compressed between the foot and the ground during walking, running, or other ambulatory activities. The configuration of sole structure 104 may vary significantly in different embodiments to include a variety of conventional or nonconventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is hard or soft. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole or sockliner. In addition, in some cases, sole structure 104 can include one or more cleat members or traction elements that are configured to increase traction with the ground's surface.

In some embodiments, sole structure 104 may include multiple components or layers, which may, individually or collectively, provide article 100 with a number of attributes, such as support, rigidity, flexibility, stability, cushioning, comfort, reduced weight, or other attributes. For purposes of this disclosure, a sole member or "layer" refers to a segment or portion of the sole structure that extends along a horizontal direction or is disposed within a substantially similar level of the sole structure. In other words, a layer can be a horizontally arranged section of the sole structure that can be disposed above, between, or below other adjacent layers of materials. Each layer can incorporate one or more portions of increased or decreased expansion properties relative to other layers in sole structure 104. In some embodiments, a layer may comprise various structural features that enhance cushioning or support for a wearer. In other embodiments, a layer may comprise materials or a geometry configured to improve distribution of forces applied along the sole structure. Furthermore, a layer may include one or more protruding portions or projections that extend proximally (i.e., upward) or distally (i.e., downward) in some embodiments. In addition, a layer may include one or more apertures or recesses in some embodiments, as will be discussed further below.

For example, in some embodiments, sole structure 104 may include a first sole member ("first member") 150 and a second sole member ("second member") 160. In some cases, however, one or more of these components may be omitted, or there may be additional components comprising sole structure 104. First member 150 and second member 160 will be discussed in further detail below.

In addition, in some embodiments, an insole may be disposed in the void defined by upper 102. The insole may extend through each of forefoot region 105, midfoot region 125, and heel region 145, and between lateral side 185 and medial side 165 of article 100. The insole may be formed of a deformable (for example, compressible) material, such as polyurethane foam, or other polymer foam materials. Accordingly, the insole may, by virtue of its compressibility, provide cushioning, and may also conform to the foot in order to provide comfort, support, and stability. However, other embodiments may not include an insole.

In different embodiments, first member 150 can comprise a midsole. As shown in FIG. 1, first member 150 can be understood to comprise a midsole component that is disposed between upper 102 and second member 160. In other embodiments, first member 150 may comprise another type of layer or component in sole structure 104. In some embodiments, first member 150 may be fixedly attached to a lower area of upper 102, for example, through stitching, adhesive bonding, thermal bonding (such as welding), or other techniques, or may be integral with upper 102. First member 150 may be formed from any suitable material having the properties described above, according to the activity for which article 100 is intended. In some embodiments, first member 150 may include a foamed polymer material, such as polyurethane (PU), ethyl vinyl acetate (EVA), or any other suitable material that operates to attenuate ground reaction forces as sole structure 104 contacts the ground during walking, running, or other ambulatory activities.

First member 150 and second member 160 may each extend through each of forefoot region 105, midfoot region 125, and heel region 145, and between lateral side 185 and medial side 165 of article 100. In some embodiments, portions of first member 150 may be exposed or visible around the periphery of article 100, when article 100 is assembled. In other embodiments, first member 150 may be completely covered by other elements, such as material layers from upper 102.

In addition, in some embodiments, second member 160 can comprise an outsole component. In other embodiments, second member 160 may comprise another type of layer or component in sole structure 104. In different embodiments, second member 160 could be manufactured from a variety of different materials. Exemplary materials include, but are not limited to, rubber (e.g., carbon rubber or blown rubber), polymers, thermoplastics (e.g., thermoplastic polyurethane), as well as possibly other materials. It will be understood that the type of materials for outsoles and midsole (or insole) components could be selected according to various factors including manufacturing requirements and desired performance characteristics. In an exemplary embodiment, suitable materials for outsoles and midsoles could be selected to ensure an outsole has a larger coefficient of friction than a midsole.

Furthermore, as shown in FIG. 1, article 100 may include a tongue 172, which may be provided near or along a throat opening leading to opening 130 of article 100. In some embodiments, tongue 172 may be provided in or near an instep region of article 100. However, in other embodiments, tongue 172 may be disposed along other portions of an article of footwear, or an article may not include a tongue.

Sole structure 104, as shown in FIG. 1 and as described further in detail below, can have an auxetic structure. Articles of footwear having sole structures comprised of an auxetic structure are described in Cross, U.S. Patent Publication Number 2015/0075033, published on Mar. 19, 2015 (previously U.S. patent application Ser. No. 14/030,002, filed Sep. 18, 2013), and entitled "Auxetic Structures and Footwear with Soles Having Auxetic Structures" (herein referred to as the "Cross application"), as well as in Cross, U.S. Patent Publication Number 2015/0245685, published on Sep. 3, 2015 (previously U.S. patent application Ser. No. 14/643,427, filed Mar. 10, 2015), and entitled "Auxetic Sole with Dual Sided Recesses," Cross, U.S. Patent Publication Number 2015/0245685 published on Sep. 3, 2015 (previously U.S. patent application Ser. No. 14/643,274, filed Mar. 10, 2015), and entitled "Auxetic Structures And Footwear With Soles Having Auxetic Structures," Cross, U.S. Patent Publication Number US 2015/0230548, published on Aug. 20, 2015 (previously U.S. patent application Ser. No. 14/643,145, filed Mar. 10, 2015), and entitled "Footwear Soles With Auxetic Material," Cross, U.S. Patent Publication Number US 2015/0075034, published on Mar. 19, 2015 (previously U.S. patent application Ser. No. 14/549,185, filed Nov. 20, 2014), and entitled "Auxetic Structures And Footwear With Soles Having Auxetic Structures," Cross, U.S. Patent Publication Number US 2015/0237958, published on Aug. 27, 2015 (previously U.S. patent application Ser. No. 14/643,089, filed Mar. 10, 2015), and entitled "Midsole Component and Outer Sole Members With Auxetic Structure," and Cross, U.S. Patent Publication Number US 2015/0245686, published on Sep. 3, 2015 (previously U.S. patent application Ser. No. 14/643,121, filed Mar. 10, 2015), and entitled "Sole Structure With Holes Arranged in Auxetic Configuration," the entirety of which applications are hereby incorporated by reference. It should be understood that the embodiments described herein with respect to sole structure 104 and its auxetic properties may also be used to describe an auxetic structure independent of a sole structure or a component for an article of footwear. In other words, some embodiments may include a general auxetic structure comprising the properties and features disclosed herein with respect to a sole structure.

In some embodiments, the various components of sole structure 104 may further be characterized as having outermost surfaces. Referring to FIG. 1, it can be understood that first member 150 has a first proximal surface 152 and a first distal surface 154 that is opposite first proximal surface 152. In some embodiments, first proximal surface 152 faces toward upper 102, and first distal surface 154 faces toward second member 160. Furthermore, first member 150 includes a first side surface 156 that is disposed or extends between first proximal surface 152 and first distal surface 154. Similarly, in some embodiments, it can be understood that second member 160 has a second proximal surface 162 and a second distal surface 164 that is opposite second proximal surface 162. In some embodiments, second proximal surface 162 faces toward second member 160, and second distal surface 164 can face toward a ground surface. Furthermore, second member 160 includes a second side surface 166 that is disposed or extends between second proximal surface 162 and second distal surface 164.

In some embodiments, the various components of sole structure 104 may be associated with a thickness. In some embodiments, a first thickness 158 may be characterized as the distance between first proximal surface 152 and first distal surface 154 of a portion of first member 150. In some embodiments, first thickness 158 may be less than or equal to the height of first side surface 156. Similarly, in some embodiments, a second thickness 168 may be characterized as the distance between second proximal surface 162 and second distal surface 164 of a portion of second member 160. In some embodiments, second thickness 168 may be less than or equal to the height of second side surface 166.

Figure 7:
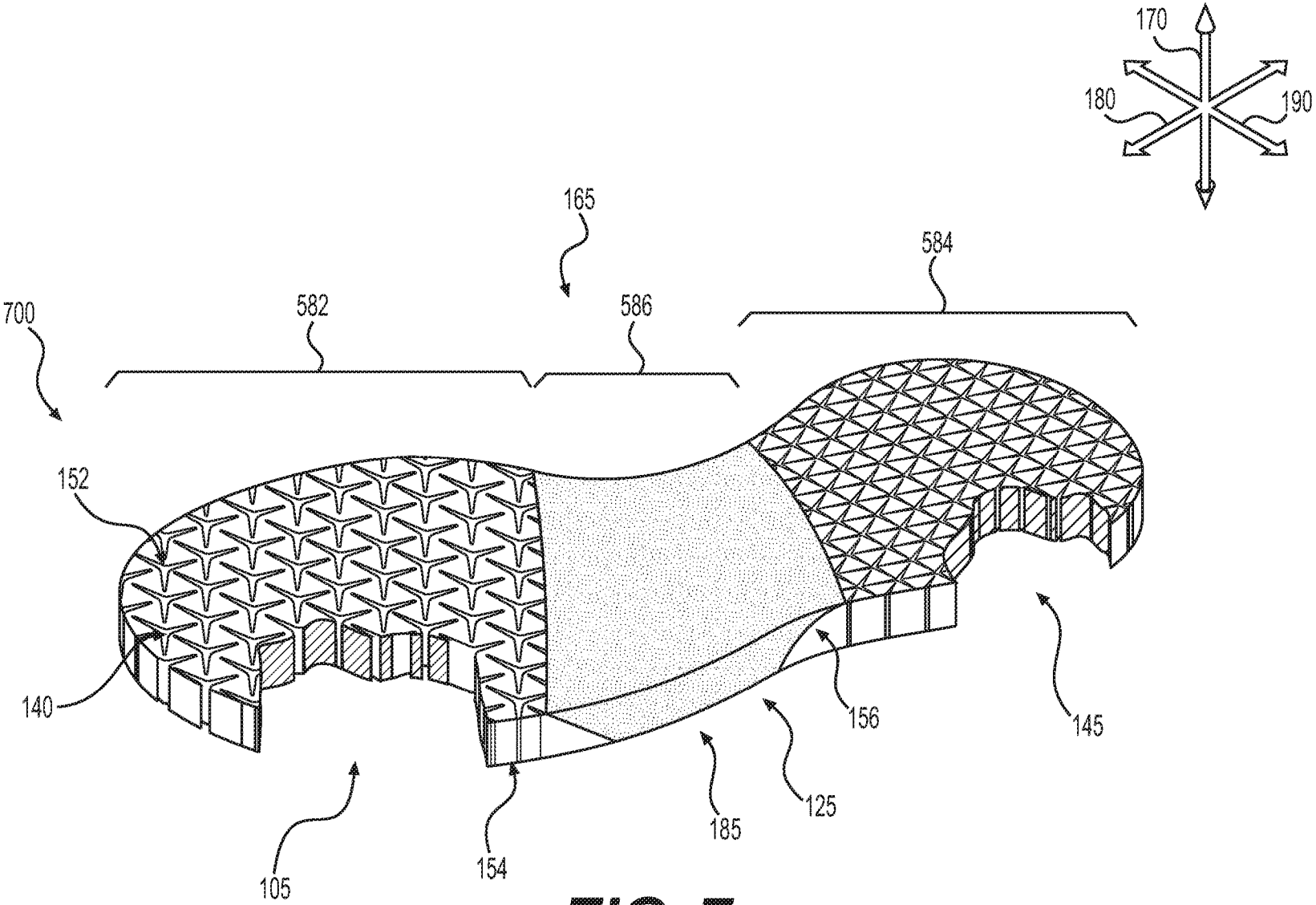
FIG. 7 is an isometric top view of an embodiment of a midsole for an article of footwear.

In some embodiments, the thicknesses of each component (e.g., first thickness 158 and/or second thickness 168) may be uniform as various portions or sections of the sole member have a uniform distance between the proximal surface and the distal surface. However, in some other embodiments, the thickness throughout the sole member may be variable, as some portions have greater distances between the proximal surface and the distal sole surface relative to other portions. The variable thickness may allow for differing degrees of flexibility for the sole member and sole structure 104 as a whole. Some examples of this variability will be discussed further below with respect to FIGS. 7 and 12.

In some embodiments, sole structure 104 may include provisions for permitting changes in the shape and/or size of first member 150 and/or second member 160. In some embodiments, one or both of first member 150 and second member 160 can include auxetic materials. For purposes of reference, it will be understood that auxetic materials have a negative Poisson's ratio, as described in the Cross application, such that when they are under tension in a first direction, their dimensions increase both in the first direction and in a second direction orthogonal or perpendicular to the first direction.

Embodiments can include provisions to facilitate expansion and/or adaptability of a sole structure during dynamic motions. In some embodiments, a sole structure may be configured with auxetic provisions. In particular, one or more layers or components of the sole structure may be capable of undergoing auxetic motions (e.g., expansion and/or contraction). Structures that expand in a direction orthogonal to the direction under tension, as well as in the direction under tension, are known as auxetic structures.

In some embodiments, one or more layers of sole structure 104 may include a plurality of apertures ("apertures") 140. Apertures 140 can be arranged along forefoot region 105, midfoot region 125, and/or heel region 145 of first member 150 and/or second member 160 in some embodiments. However, in other embodiments, apertures 140 may be arranged in only particular regions of portions of sole structure 104. For example, as shown in FIG. 1, apertures 140 may only be formed along forefoot region 105 and heel region 145 in one embodiment.

Generally, apertures 140 can comprise various openings or holes arranged in a variety of orientations and in a variety of locations on or through first member 150 and/or second member 160. For example, as shown in FIG. 1, in some embodiments, second member 160 may include apertures 140 that extend in a direction generally aligned with vertical axis 170 through second thickness 168 of second member 160. In some embodiments, apertures 140 may be understood to begin from a distal end formed through second distal surface 164 and extend upward toward second proximal surface 162 to a proximal end. Thus, apertures 140 can include a series of openings (i.e., holes, gaps, or breaks) along an exterior surface of first layer 110 in some cases. In FIG. 1, second distal surface 164 comprises one of the exterior surfaces in which the series of openings (shown in greater detail in FIGS. 2 and 3 below) are formed. As will be discussed further below, in some embodiments, apertures 140 may extend from an initial opening associated with the distal end, through second thickness 168 of second member 160, to form tunneled spaces, channels, or through-holes in the member.

In different embodiments, the apertures can comprise varying sizes and depths. In some embodiments, apertures 140 could include polygonal apertures. For example, one or more apertures 140 could have a polygonal cross-sectional shape (where the cross section is taken along a plane parallel with a horizontal surface of second member 160). In other embodiments, however, each aperture could have any other geometry, including geometries with non-linear edges that connect adjacent vertices. In the embodiment shown in FIG. 1, apertures 140 in second member 160 appear as three-pointed stars (also referred to herein as triangular stars or as tri-stars), surrounded by a plurality of auxetic members or elements ("auxetic members") 132. For example, one or more of the apertures 140 may have a simple isotoxal star-shaped polygonal shape. In this exemplary embodiment, auxetic members 132 are triangular. In other embodiments, the apertures may have other geometries and may be surrounded by auxetic members having other geometries. For example, the auxetic members may be geometric features. The triangular features of auxetic members 132 shown in FIG. 1 are one example of such geometric features. Other examples of geometric features that might be used as auxetic members are quadrilateral features, trapezoidal features, pentagonal features, hexagonal features, octagonal features, oval features, and circular features.

Furthermore, in the embodiment shown in FIG. 1, joints or hinge portions 134 extending between each of auxetic members 132 can function as hinges, allowing the generally triangular auxetic members 132 to rotate as the sole member is placed under tension. In some embodiments, hinge portions 134 are adjacent to each of the vertices of apertures 140. When a portion of the sole member is under tension, the hinge portions allow the portion of the sole under tension to expand both in the direction under tension and in the direction in the plane of the sole that is orthogonal to the direction under tension. Thus, in some embodiments, first member 150 and/or second member 160 may have an auxetic structure, as will be discussed below.

Figure 2:
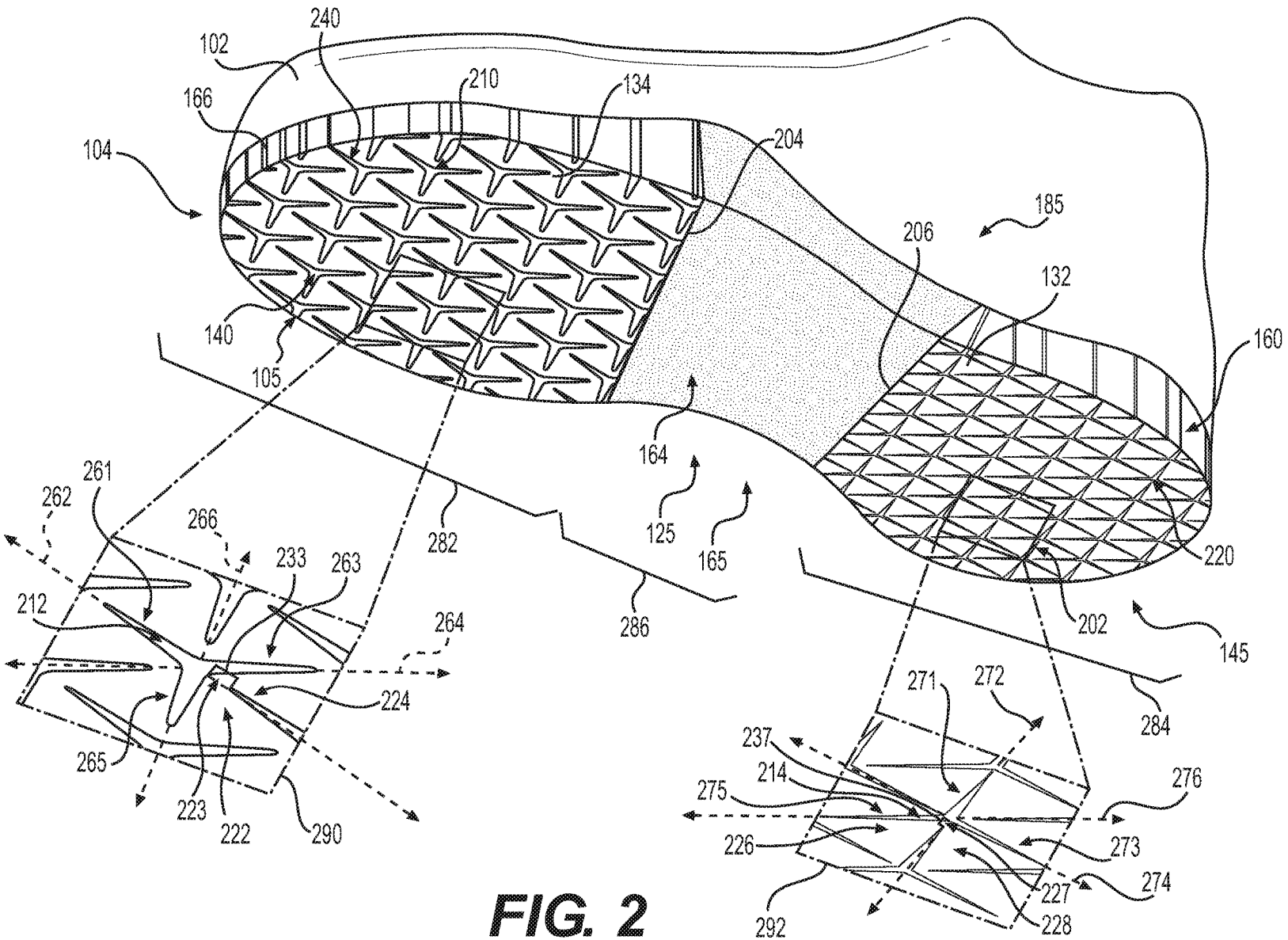
FIG. 2 is an isometric bottom view of an embodiment of a sole structure in an article of footwear.

FIG. 2 depicts an isometric bottom view of an embodiment of article 100. Second distal surface 164 and a portion of second side surface 166 of second member 160 can be seen in FIG. 2. As noted above, in some embodiments, one or more portions of sole structure 104 can have an auxetic structure or comprise one or more types of an auxetic material 202. In FIG. 2, for purposes of reference, second member 160 includes a first auxetic portion 282, a second auxetic portion 284, and a distal intermediate portion 286. Furthermore, it should be understood that the auxetic structures of second member 160 are not under tension, or are in a neutral state.

For purposes of clarity, the embodiments herein may discuss a subset of auxetic members 132 and their relative configuration. However, it will be understood that these particular members are only meant to be a representation, and the components of sole structure 104 can be comprised of many other members arranged in similar patterns. Moreover, in other embodiments, auxetic members 132 of sole structure 104 may generally be tiled in a regular pattern comprised of smaller sets of additional members that have a configuration substantially similar to auxetic members 132. As shown in FIG. 2, auxetic material 202 comprising different portions of second member 160 can include a first group of auxetic members ("first group") 210 disposed in first auxetic portion 282 and a second group of auxetic members ("second group") 220 disposed in second auxetic portion 284. The first group 210 and the second group 220 of auxetic members may alternatively be referred to as the first subset and the second subset, respectively.

As noted above, in some embodiments, the material of sole members that comprise various hinge portions 134 of an aperture may also function as hinges. In one embodiment, adjacent portions of material, including one or more geometric portions (e.g., polygonal portions), may rotate about a hinge portion associated with a vertex of the aperture. Thus, portions or auxetic members 132 may be connected by hinges in some embodiments. The angles associated with the vertices where hinging occurs may change as the structure contracts or expands. However, in some embodiments, one or more hinge portions 134 may not function as a hinge for corresponding sides or edges. For example, some of hinge portions 134 may be static such that the angle of the vertex remains approximately unchanged during auxetic expansion.

In different embodiments, each group can include auxetic members 132 that vary in shape, size, and/or orientation. For example, as shown in FIG. 2, each of the hinge portions joining the auxetic members of first group 210 together is larger or wider than each of the hinge portions joining the auxetic members of second group 220. For purposes of clarity, FIG. 2 also includes a first enlarged view 290 of a first aperture 212 and a second enlarged view 292 of a second aperture 214. First aperture 212 is bounded in part by a first auxetic member 222 and a second auxetic member 224, where first auxetic member 222 and second auxetic member 224 are joined by a first hinge portion 223. Similarly, it can be seen that second aperture 214 is bounded in part by a third auxetic member 226 and a fourth auxetic member 228, where third auxetic member 226 and fourth auxetic member 228 are joined by a second hinge portion 227. For purposes of reference, it can be seen that first hinge portion 223 has a first width 233 and second hinge portion 227 has a second width 237, where first width 233 is larger than second width 237. In other words, the portions of the sole member that join the auxetic members in first group 210 are larger than the portions (i.e., vertices) of the sole member that join the auxetic members together in second group 220 in some embodiments. In some embodiments, the varying sizes of the hinge portions can affect the auxetic behavior of the auxetic portion. In some cases, a narrower hinge portion can increase the rate and/or degree of auxetic expansion, for example. It should be understood that in other embodiments, the portions of the sole member that join the auxetic members in first group 210 can be smaller relative to the portions (i.e., hinge portions) of the sole member that join the auxetic members together in second group 220 in some embodiments. Furthermore, in some embodiments, each of the auxetic members 132 and hinge portions 134 of first group 210 and second group 220 can be substantially similar in shape and size.

In addition, in different embodiments, the area associated with one aperture can be larger than an area associated with another aperture. For example, in FIG. 2, first aperture 212 can be understood to have a first area in the neutral state, where the first area corresponds to a cross-sectional area of first aperture 212 taken along a plane substantially aligned with a horizontal axis (e.g., lateral axis 190 or longitudinal axis 180). Similarly, second aperture 214 can be understood to have a second area in the neutral state, where the second area corresponds to a cross-sectional area of second aperture 214 taken along a plane substantially aligned with a horizontal axis (e.g., lateral axis 190 or longitudinal axis 180). In some embodiments, as shown in FIG. 2, the first area is greater than the second area. Thus, in some embodiments, the size or space of the apertures formed in first auxetic portion 282 in the neutral configuration can be larger than the apertures formed in second auxetic portion 284. However, in other embodiments, the apertures of second auxetic portion 284 may be larger than apertures of first auxetic portion 282. In addition, in one embodiment, the apertures of first auxetic portion 282 and second auxetic portion 284 may be substantially similar in size.

In some embodiments, the larger neutral size of hinge portions 134 in first group 210 in the neutral state can be associated with a slower or smaller degree of expansion relative to second group 220. In other words, in some embodiments, by including differently sized apertures 140 and/or hinge portions 134 in different regions of the sole member, the type of auxetic behavior associated with the particular portion of the sole member can also be different relative to another portion.

Furthermore, in different embodiments, sole structure 104 can include other provisions for altering the primary direction(s) of auxetic expansion or for adjusting the auxetic behavior of different portions of the sole member. For example, as shown in FIGS. 1 and 2, first group 210 can be arranged or positioned along a different orientation relative to second group 220. In other words, in some embodiments, the orientation of each of the "arms" and corresponding vertices of the apertures in first auxetic portion 282 can differ from the orientation of each of the "arms" and corresponding vertices of the apertures in second auxetic portion 284. For purposes of reference, arms 240 refer to the distinct, elongated, portions of the apertures that extend radially outward from a center point of the aperture. In some embodiments, arms 240 extend from a center point and taper to a rounded or pointed end. Referring to first enlarged view 290, it can be seen that arms 240 of first aperture 212 are arranged such that a first arm 261 is oriented along a first axis 262, a second arm 263 is oriented along a second axis 264, and a third arm 265 is oriented along a third axis 266. Furthermore, referring to second enlarged view 292, it can be seen that arms 240 of second aperture 214 are arranged such that a fourth arm 271 is oriented along a fourth axis 272, a fifth arm 273 is oriented along a fifth axis 274, and a sixth arm 275 is oriented along a sixth axis 276. In other words, for purposes of this description and claims, when two or more auxetic apertures are described as being arranged in the same or substantially similar orientation relative to one another, it can be understood that the orientation of each of the "arms" of a first aperture is aligned with the orientation of a corresponding arm in a second aperture. In contrast, two or more auxetic apertures are arranged in different orientations relative to each other when each of the "arms" of a first aperture is not aligned or is nonparallel to any arm of a second aperture.

For example, in some embodiments, one or more of the arms of first aperture 212 can differ in orientation from the arms of second aperture 214. In one embodiment, each of the arms of first aperture 212 can be oriented differently than the arms of second aperture 214. For example, in FIG. 2, first axis 262 is nonparallel to each of fourth axis 272, fifth axis 274, and sixth axis 276. Similarly, second axis 264 is nonparallel to each of fourth axis 272, fifth axis 274, and sixth axis 276, and third axis 266 is nonparallel to each of each of fourth axis 272, fifth axis 274, and sixth axis 276. In other words, the orientation of the apertures of first auxetic portion 282 is substantially different from the orientation of the apertures of second auxetic portion 284.

In contrast, the apertures formed in first auxetic portion 282 can have a substantially similar orientation in some embodiments. Similarly, in one embodiment, the apertures formed in second auxetic portion 284 can have a substantially similar orientation. In some embodiments, by arranging the arms of the apertures of one portion of a sole member along a first orientation and arranging the arms of the apertures of another portion of the same sole member along a second, different orientation, the auxetic behavior of the two portions can be altered. For example, in one embodiment, first auxetic portion 282 can rotate and expand outward primarily along a first direction when under tension, while second auxetic portion 284 can rotate and expand outward primarily along a second, different direction when under tension. In addition, the differently oriented apertures in different regions of the sole member can provide a greater aesthetic value to a user.

In addition, in different embodiments, there may be portions of a sole member that do not include auxetic materials. For example, in FIG. 2, distal intermediate portion 286 is a substantially continuous, or unbroken, region of second member 160. Thus, in some embodiments, a sole member can include regions of auxetic material as well as regions that are non-auxetic. In FIG. 2, there is a region of auxetic material in forefoot region 105 (first auxetic portion 282) and a region of auxetic material in heel region 145 (second auxetic portion 284). Extending between the two portions of auxetic material is distal intermediate portion 286. In some embodiments, distal intermediate portion 286 can be considered solid relative to either of first auxetic portion 282 or second auxetic portion 284. For example, distal intermediate portion 286 may not include any apertures or openings. Second proximal surface 162 (see FIG. 1) of distal intermediate portion 286 and second distal surface 164 of distal intermediate portion 286 may be substantially smooth in some embodiments. In other words, there may be portions or regions of a sole member that are configured to exhibit auxetic behavior in response to tension, and there may also be portions or regions of the same sole member that are not configured to exhibit auxetic behavior in response to tension.

In some embodiments, distal intermediate portion 286 may be a separate, distinct piece or material that is joined (e.g., adhered or otherwise fixedly connected) to a portion of auxetic material 202 to form a single sole member. In FIG. 2, it can be seen that a forward edge of distal intermediate portion 286 is disposed adjacent to and lies substantially flush against a rear edge of first auxetic portion 282 along a first boundary 204. Similarly, in FIG. 2, it can be seen that a rear edge of distal intermediate portion 286 is disposed adjacent to and lies substantially flush against a forward edge of second auxetic portion 284 along a second boundary 206. However, in other embodiments, second member 160 can be a single or integral piece in which apertures are drilled or otherwise formed in different portions to create auxetically configured material while other areas remain substantially smooth. Furthermore, in different embodiments, distal intermediate portion 286 can be configured for cushioning—comprising foam, for example—or may be configured for stability or support and comprise carbon fiber or other relatively rigid materials.

Figure 3:
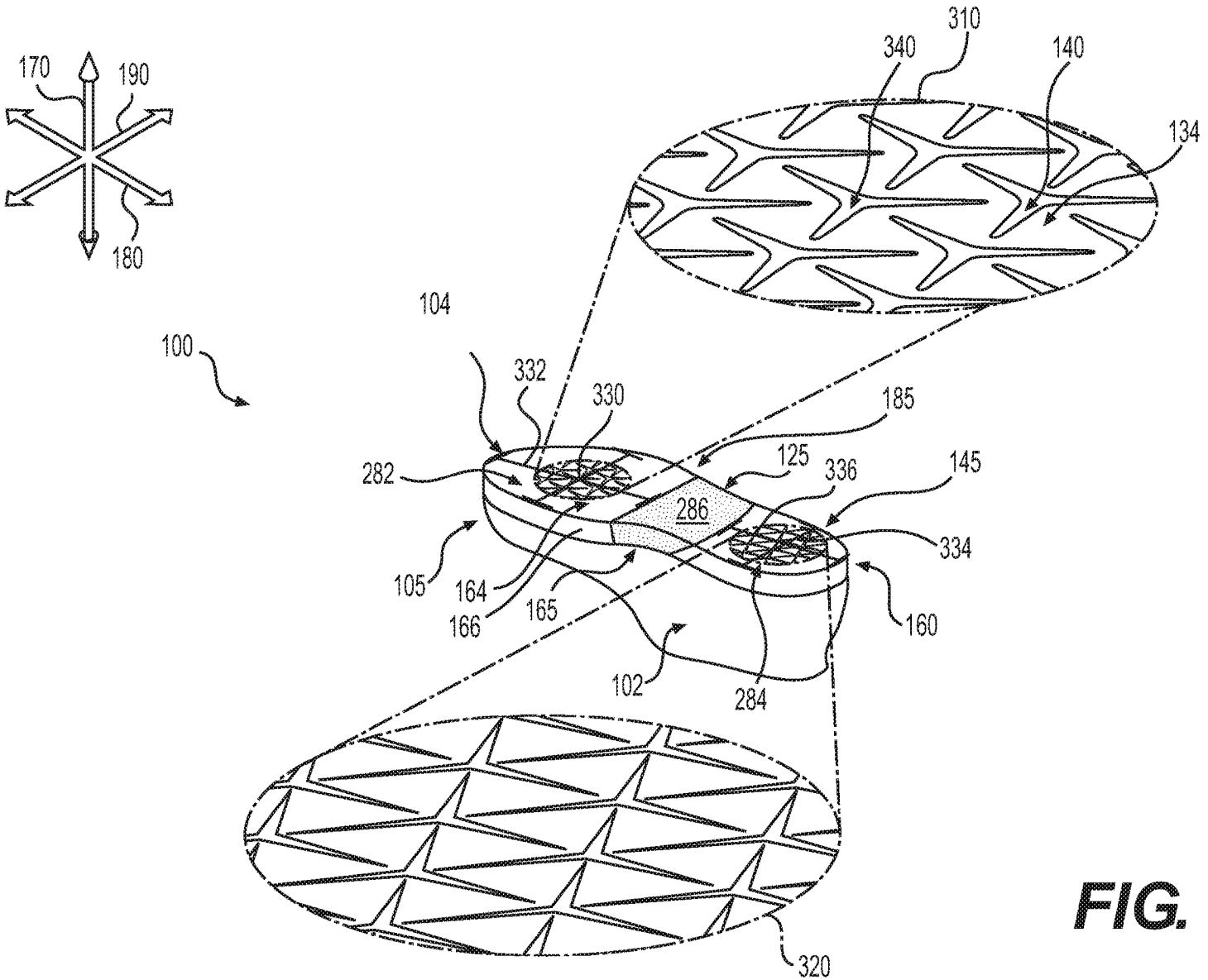
FIG. 3 is an isometric bottom view of an embodiment of a sole structure in an article of footwear in a neutral state.
Figure 4:
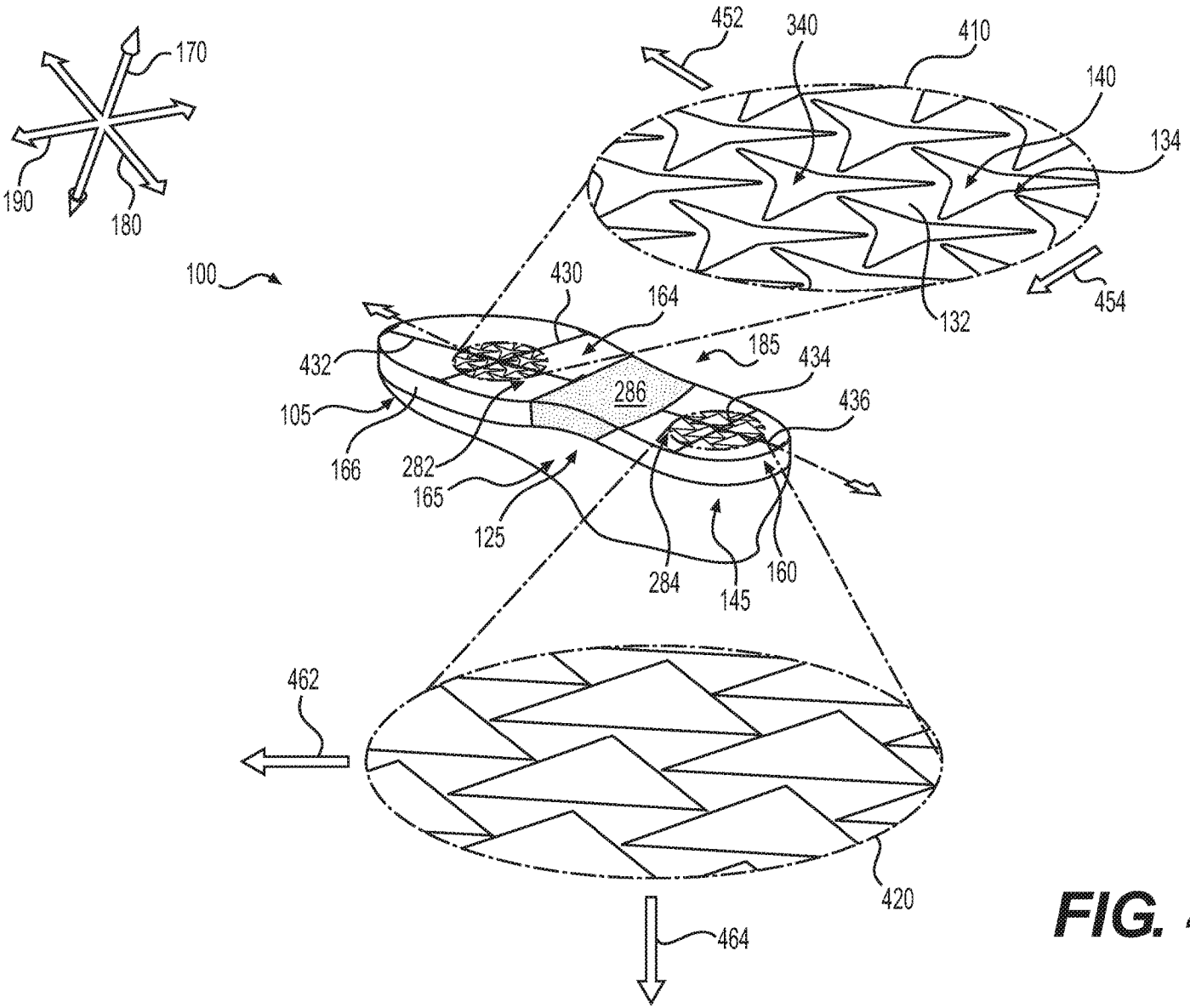
FIG. 4 is an isometric bottom view of an embodiment of a sole structure in an article of footwear in an expanded state.

In order to provide the reader with a greater understanding of some of the disclosed embodiments, FIGS. 3 and 4 show schematically how the orientation of apertures 140 and/or the size of their surrounding hinge portions 134 can result in different types of auxetic behavior. In FIG. 3, an isometric bottom view of article 100 is depicted. For purposes of clarity, only two portions of second distal surface 164 (in forefoot region 105 and heel region 145) are shown. Furthermore, a third enlarged view 310 of the illustrated portion of forefoot region 105 and a fourth enlarged view 320 of the illustrated portion of heel region 145 are included.

In FIG. 3, second member 160 is at rest or in the neutral state, where no external tension is being applied to sole structure 104. First auxetic portion 282 and second auxetic portion 284 each have an initial set of dimensions. For example, first auxetic portion 282 has a first initial width 330 and a first initial length 332 during the initial (unstressed) state of FIG. 3. Similarly, second auxetic portion 284 has a second initial width 334 and a second initial length 336 during the initial (unstressed) state of FIG. 3.

In some embodiments, in the unstressed state, as discussed above, the auxetic material has apertures 140 surrounded by auxetic members 132 and hinge portions 134. In the embodiment shown in FIG. 3, apertures 140 are triangular star-shaped apertures, auxetic members 132 are generally triangular features. In addition, for purposes of this disclosure, openings 340 represent the interior of triangular star-shaped apertures 140, where each opening is bounded by the vertices of the aperture. As best shown in the enlarged views, in one embodiment, openings 340 may be characterized as having a relatively small acute angle along each of the vertices when the auxetic material is not under tension.

Referring now to FIG. 4, an illustration of the bi-directional expansion of second member 160 when it is under tension is depicted, producing an expanded state or stressed state for the sole structure. Thus, FIGS. 3 and 4 can provide a comparison of two portions of an embodiment of second member 160 in its unstressed, initial state (shown in FIG. 3) as well as in the expanded state, when tension is applied to sole structure 104. In FIG. 4, the application of tension to second member 160 rotates adjacent auxetic members 132, which increases the relative spacing between adjacent auxetic members. In some embodiments, as seen in FIG. 4, the relative spacing between adjoining auxetic members 132 (and thus the size of apertures 140) increases with the application of tension. Because the increase in relative spacing occurs in all directions (due to the geometry of the original geometric pattern of apertures), this results in an expansion of the auxetic material along both the direction under tension, and along the direction orthogonal to the direction under tension.

Thus, in the expanded state or resultant state (seen in FIG. 4), first auxetic portion 282 has an increased first resultant width 430 (relative to FIG. 3) in the direction under tension and an increased first resultant length 432 (relative to FIG. 3) in the direction that is orthogonal to the direction under tension. Similarly, second auxetic portion 284 has an increased second resultant width 434 (relative to FIG. 3) in the direction under tension and an increased second resultant length 436 (relative to FIG. 3) in the direction that is orthogonal to the direction under tension. It should be understood that the expansion of auxetic material 202 is not limited to expansion in the direction under tension.

In some embodiments, due to the different arrangement of first auxetic portion 282 relative to second auxetic portion 284, there may be variations in the auxetic behavior of each portion of auxetic material 202. In one embodiment, as shown in fifth enlarged view 410 of FIG. 4, first auxetic portion 282 of second member 160 exhibits a first type of auxetic behavior ("first behavior"). In addition, as shown in sixth enlarged view 420, second auxetic portion 284 of second member 160 exhibits a second type of auxetic behavior ("second behavior"). In some embodiments, the first behavior represents a smaller degree of expansion along the direction associated with width (i.e., less of an increase or change from first initial width 330 to first resultant width 430 relative to the larger increase or change between second initial width 334 to second resultant width 434). Similarly, the first behavior represents a smaller degree of expansion along the direction associated with length (i.e., less of an increase or change from first initial length 332 to first resultant length 432 relative to the larger increase or change between second initial length 336 to second resultant length 436). In contrast, the second behavior represents a larger degree of expansion along the directions associated with width and length relative to the first auxetic behavior. In some embodiments, the second auxetic behavior can be associated with a greater overall expansion of individual apertures within the sole structure. In other words, in some embodiments, the apertures of second auxetic portion 284 can expand or open up more (to a greater area) than the apertures of first auxetic portion 282. Thus, it can be understood that in one embodiment, each of the apertures of second auxetic portion 284 may expand to a greater size (i.e., area or volume) than the apertures of first auxetic portion 282.

In addition, in some embodiments, as noted earlier, the primary directions of expansion can differ depending on the orientation of the apertures. In FIG. 4, for example, the application of tension results in expansion of first auxetic portion 282 mainly along a first direction 452 and a second direction 454, and the application of tension results in expansion of second auxetic portion 284 mainly along a third direction 462 and a fourth direction 464. In some embodiments, first direction 452 is different from either of third direction 462 and fourth direction 464, and second direction 454 can also differ from either of third direction 462 and fourth direction 464. In other embodiments, the directions (i.e., first direction 452, second direction 454, third direction 462, and fourth direction 464) can differ from what is depicted here.

Thus, in some embodiments, one or more layers of sole structure 104 of FIG. 1 can have two or more distinct portions of auxetic material that are associated with different types of auxetic behavior. It can also be noted that while expansion occurs in forefoot region 105 and heel region 145 in FIG. 4, midfoot region 125—where distal intermediate portion 286 is disposed—remains substantially static (i.e., does not expand significantly) and does not exhibit auxetic behavior.

Figure 5:
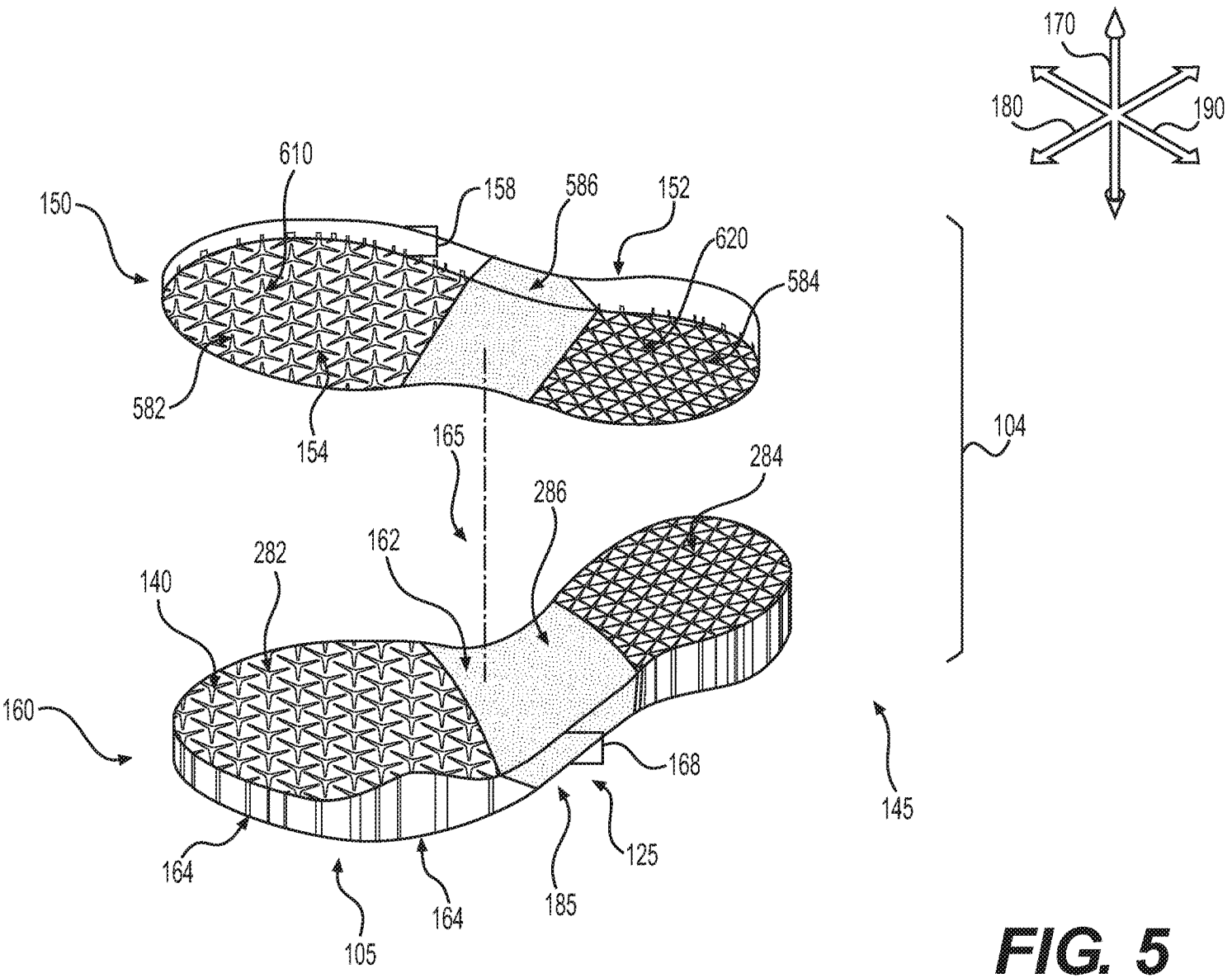
FIG. 5 is an exploded view of an embodiment of a sole structure for an article of footwear.
Figure 6:
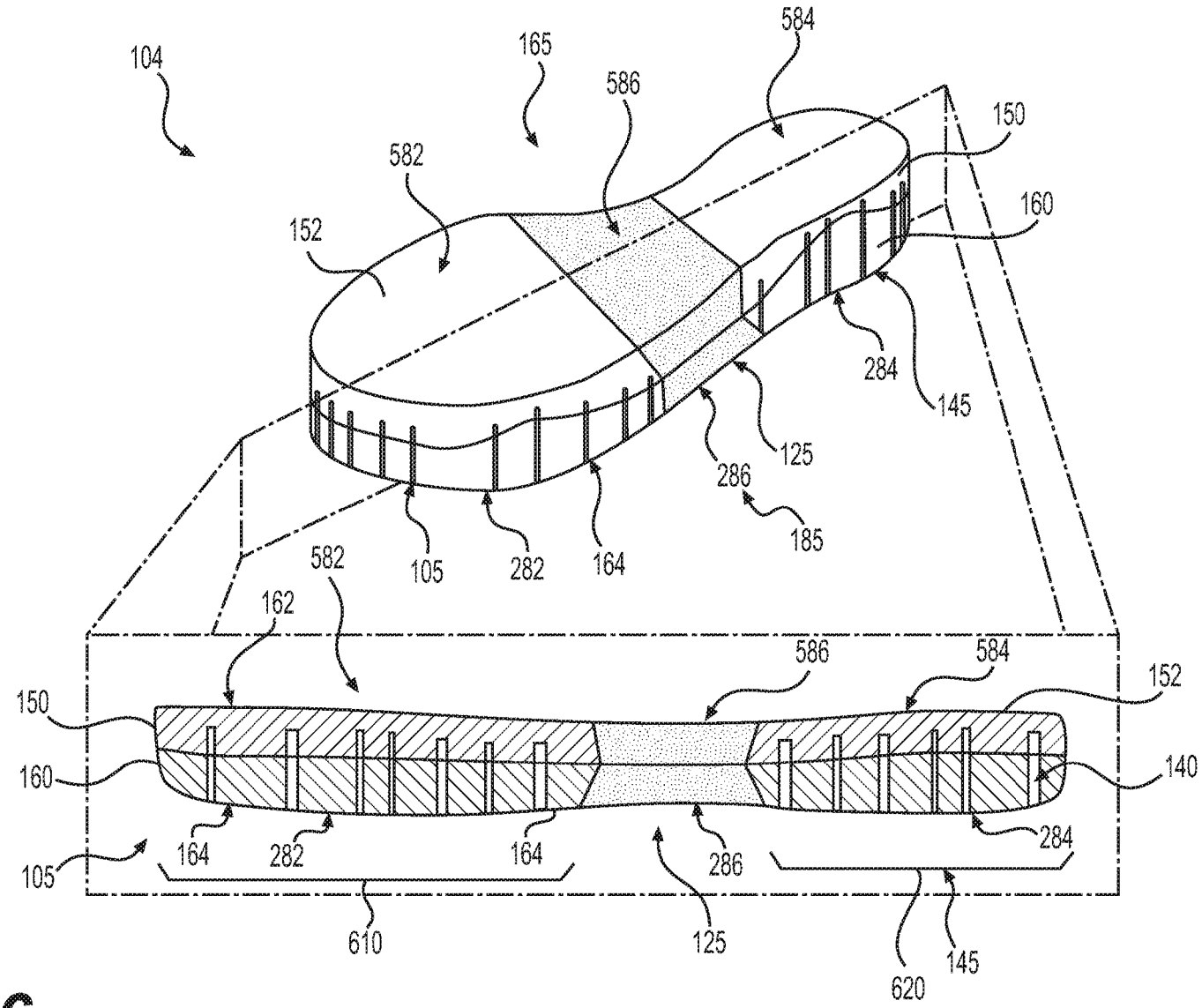
FIG. 6 is an isometric assembled view of an embodiment of a sole structure.

Referring now to FIGS. 5 and 6, in different embodiments, an article of footwear can include provisions for coordinating and/or aligning the auxetic behavior of first member 150 with second member 160. In FIG. 5, an isometric exploded view of sole structure 104 is depicted, where first member 150 is disposed above second member 160. First distal surface 154 of first member 150 is shown facing downward. Furthermore, similar to second member 160, first member 150 includes two auxetic portions, comprising of a third auxetic portion 582 and a fourth auxetic portion 584, as well as a proximal intermediate portion 586. In different embodiments, proximal intermediate portion 586 can be configured for cushioning—comprising foam, for example—or may be configured for stability or support and comprise carbon fiber or other relatively rigid materials.

In some embodiments, third auxetic portion 582 and fourth auxetic portion 584 can each include apertures, auxetic portions, and hinge portions, where the features, properties, and/or structural characteristics of the apertures, auxetic portions, and hinge portions can be substantially similar to those discussed above with respect to second member 160. Furthermore, the apertures, auxetic portions, and hinge portions of third auxetic portion 582 can be substantially similar in arrangement, shape, geometry, and configuration to those of first auxetic portion 282 in some embodiments. Similarly, in some embodiments, the apertures, auxetic portions, and hinge portions of fourth auxetic portion 584 can be substantially similar in arrangement, shape, geometry, and configuration to those of second auxetic portion 284.

However, as shown in FIG. 6, it should be understood that, in some embodiments, while apertures 140 formed in portions of second member 160 may be through-hole apertures, apertures 140 formed in portions of first member 150 may be blind-hole apertures. For purposes of this disclosure, a "through-hole" aperture refers to a type of aperture that includes a first open end along one surface side (e.g., a distal surface) and a second open end along a second, opposing surface side (e.g., a proximal surface). In other words, the aperture has a continuous, constant opening extending through the interior or thickness of the sole member, where each of the two ends of the aperture may match or correspond in dimension and shape with each other. For example, referring back to FIG. 1, in second member 160, the through-hole apertures extend through second thickness 168 and are associated with openings along both second proximal surface 162 and second distal surface 164. In contrast, a "blind-hole" aperture includes a first open end formed along one surface side (i.e., either the distal surface or the proximal surface), extends partway through the thickness of the sole member, and ends at a second closed end bounded by the material of the sole member.

Furthermore, in some embodiments, as shown in FIG. 6, when first member 150 and second member 160 are disposed against one another in an assembled sole structure 104, some or all of apertures 140 formed in first auxetic portion 282 can align directly with some or all of apertures 140 formed in third auxetic portion 582. Similarly, when first member 150 and second member 160 are disposed against one another in an assembled sole structure 104, some or all of apertures 140 formed in second auxetic portion 284 can align directly with some or all of apertures 140 formed in fourth auxetic portion 584 in some embodiments. In other words, in some embodiments, an aperture can extend from second distal surface 164, through second thickness 168 toward second proximal surface 162, and continue to extend into first distal surface 154, and through at least part of first thickness 158, toward first proximal surface 152. Thus, in one embodiment, a set of apertures can extend through second member 160 and at least partially through first member 150. As shown in FIG. 6, in some embodiments, there may be a first set of apertures ("first set") 610 extending through second member 160 and at least partially through first member 150 in forefoot region 105, and there may be a second set of apertures ("second set") 620 extending through second member 160 and at least partially through first member 150 in heel region 145.

In addition, in different embodiments, distal intermediate portion 286 and proximal intermediate portion 586 can also be substantially similar in their relative positions when first member 150 and second member 160 are assembled and disposed adjacent to one another. In other words, when first member 150 and second member 160 are disposed against one another in an assembled sole structure 104, some or all of the material comprising each of distal intermediate portion 286 and proximal intermediate portion 586 can be aligned. Thus, in one embodiment, second proximal surface 162 (see FIG. 1) of distal intermediate portion 286 can face toward and/or directly contact some or all of first distal surface 154 (see FIG. 1) of proximal intermediate portion 586.

In other embodiments, in contrast to the blind-hole apertures formed in first member 150 in FIGS. 5 and 6, a first member may include through-hole apertures. For example, referring to the cutaway views provided in FIG. 7, an alternate first member 700 is depicted in which both third auxetic portion 582 and fourth auxetic portion 584 of alternate first member 700 include through-hole apertures. Thus, in some embodiments, when alternate first member 700 is disposed against second member 160 as described earlier (see FIGS. 5 and 6) in an assembled sole structure, some or all of apertures 140 formed in the first auxetic portion of the second member can align directly with some or all of apertures 140 formed in the third auxetic portion 582. Similarly, in some embodiments, when alternate first member 700 and second member 160 (see FIG. 6) are disposed against one another in an assembled sole structure, some or all of apertures 140 formed in the second auxetic portion of the second member can align directly with some or all of apertures 140 formed in fourth auxetic portion 584. In other words, in some embodiments, an aperture can extend from the second distal surface of the second member, through the second thickness, toward the second proximal surface, and then continue by extending into first distal surface 154, through the entirety of first thickness 158, and ending in first proximal surface 152. Thus, in one embodiment, a set of apertures can extend through the entire thickness of the second member as well as through the entire thickness of first member 150.

In different embodiments, one or more layers of the sole structure can include provisions for varying the cushioning and/or expansion. In the embodiments shown herein, an auxetic structure, including the first member and the second member that include auxetic material, may generally be tensioned in the longitudinal direction or in the lateral direction. However, it should be understood that the configuration discussed in this application for auxetic structures comprised of geometric apertures surrounded by geometric portions provides a structure that can expand along any first direction along which tension is applied, as well as along a second direction that is orthogonal to the first direction. Moreover, it should be understood that the directions of expansion, namely the first direction and the second direction, may generally be tangential to a surface of the auxetic structure. In particular, the auxetic structures discussed here may generally not expand substantially in a vertical direction that is associated with a thickness of the auxetic structure. However, as a foot or other force compresses the sole structure, the thickness of the layer(s) can decrease in some embodiments. Furthermore, while auxetic expansion may not substantially occur in a direction aligned with vertical axis 170, the thickness of the layer(s) can influence the type of auxetic behavior that occurs as the sole layer is tensioned.

Figure 8:
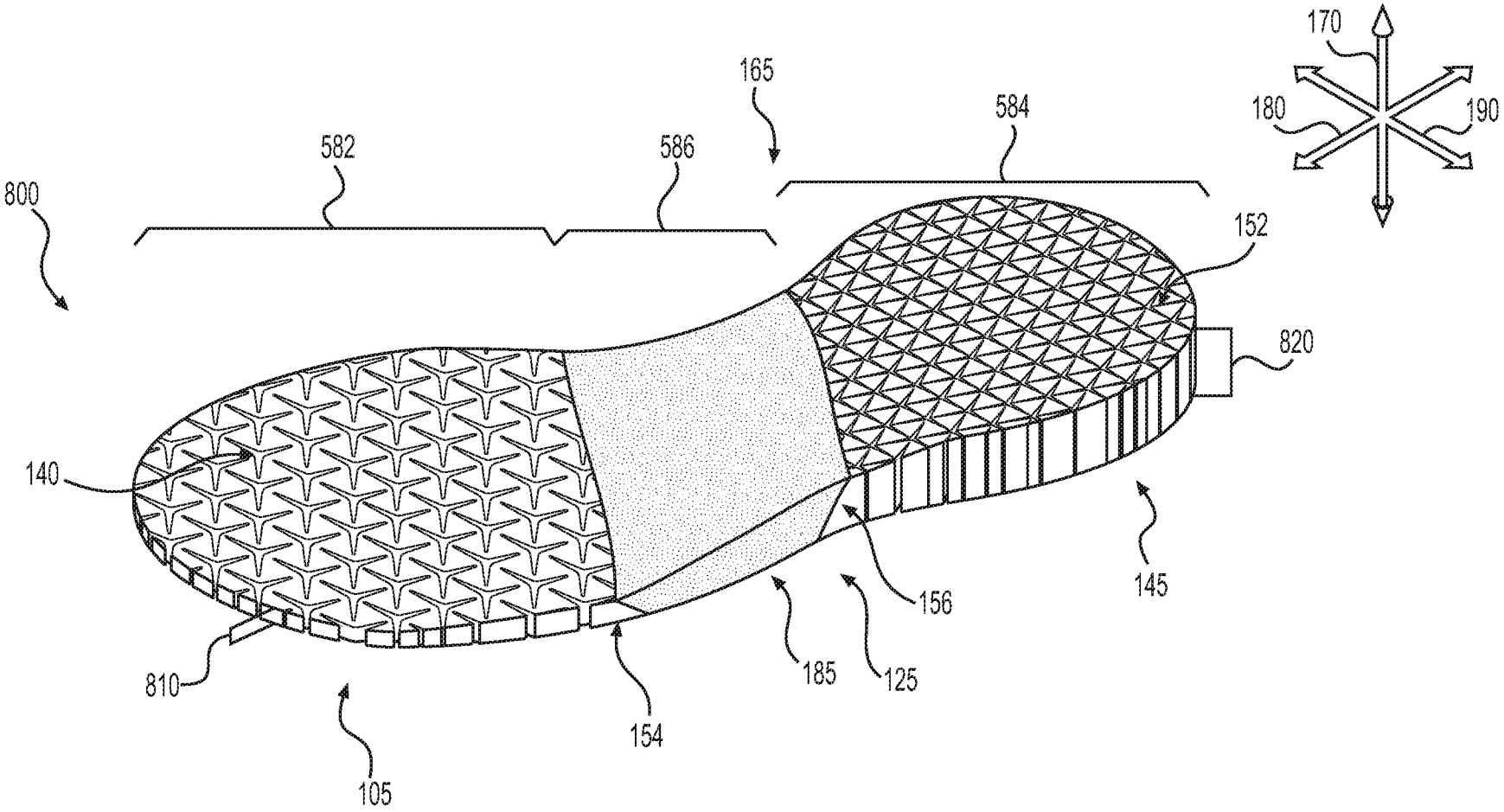
FIG. 8 is an isometric top view of an embodiment of a midsole for an article of footwear.

For example, in some embodiments, the thickness associated with a layer of the sole structure can affect the manner in which the expansion of an auxetic portion occurs in the first direction and the second direction. Referring to FIG. 8, it can be seen that in some embodiments, one auxetic portion can be substantially thicker than a second auxetic portion in the same sole layer. For example, an embodiment of a first member 800 is depicted in FIG. 8 in which third auxetic portion 582 includes a third thickness 810 and fourth auxetic portion 584 includes a fourth thickness 820. In one embodiment, third thickness 810 is substantially smaller than that of fourth thickness 820. In other embodiments, third thickness 810 can be larger than fourth thickness 820, or third thickness 810 may be substantially similar to fourth thickness 820. In some embodiments, third thickness can be thin enough such that third auxetic portion 582 may be configured as a two-dimensional material, in contrast to fourth auxetic portion 584. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example.

In different embodiments, fourth auxetic portion 584 can provide greater cushioning to a user relative to third auxetic portion 582. In addition, when a force is applied to first member 800, third auxetic portion 582 may exhibit a greater degree of "splay out" or outward expansion compared to fourth auxetic portion 584. In other words, because of the decreased thickness of third auxetic portion 582 compared to fourth auxetic portion 584, the auxetic material comprising third auxetic portion 582 may move or rotate outward more readily.

Figure 9:
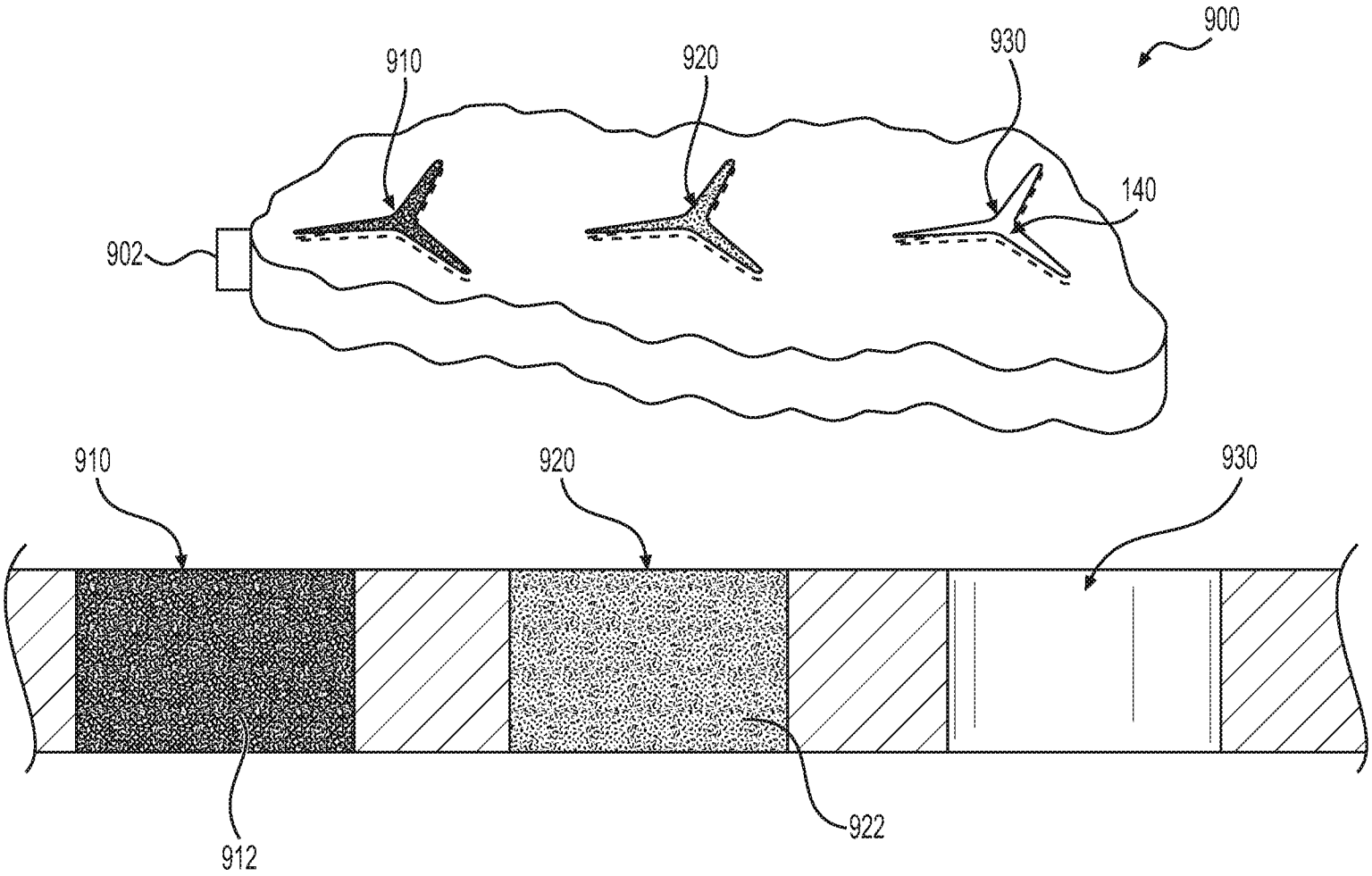
FIG. 9 is an isometric view of an embodiment of a portion of a sole layer with apertures.

In some embodiments, the sole structure may include additional provisions for adjusting or otherwise tuning the degree of auxetic expansion of the auxetic material in a sole member. For example, while apertures 140 in the figures above have been depicted as voids or hollow tunnels extending through a sole member, it should be understood that in other embodiments, one or more apertures may be at least partially filled or "plugged" with various materials. Referring to FIG. 9, an auxetic segment 900 is illustrated. For purposes of clarity, only three apertures are shown in auxetic segment 900. However, auxetic segment 900 may represent only a small region of a larger auxetic material.

In FIG. 9, auxetic segment 900 has a fifth thickness 902, and includes a first aperture 910, a second aperture 920, and a third aperture 930. In some embodiments, each aperture in auxetic segment 900 may be generally similar in structure, geometry, and properties as the other apertures described earlier herein. In addition, one or more apertures can also include an interior portion. For purposes of this disclosure, an "interior portion" refers to any material that is disposed, filled, plugged, or otherwise arranged in an aperture such that the interior volume of the aperture that extends through at least a part of the thickness of the auxetic material is no longer hollow. In the cross section of FIG. 9, first aperture 910 includes a filling comprised of a first interior portion 912, and second aperture 920 includes a filling comprises of a second interior portion 922. Third aperture 930 remains hollow to provide the reader with a contrasting example.

In some embodiments, the material comprising first interior portion 912 may be substantially similar to that of second interior portion 922, or they may differ. For example, in some embodiments, first interior portion 912 can include a material with a first degree of elasticity, and second interior portion 922 can include a material with a second degree of elasticity, where the first degree is less than the second degree. In other words, the properties of the materials in either of first interior portion 912 or second interior portion 922 can be selected to provide additional functional or structural characteristics to the sole member. In one embodiment, the apertures may be filled with a material that increases the cushioning in the sole member. In another embodiment, the apertures may be filled with a material that is spongy or highly stretchy, allowing a high degree of expansion. In some other embodiments, the material selected can lessen or fine-tune the degree of expansion of the sole member in one or more regions of the sole member.

Figure 10:
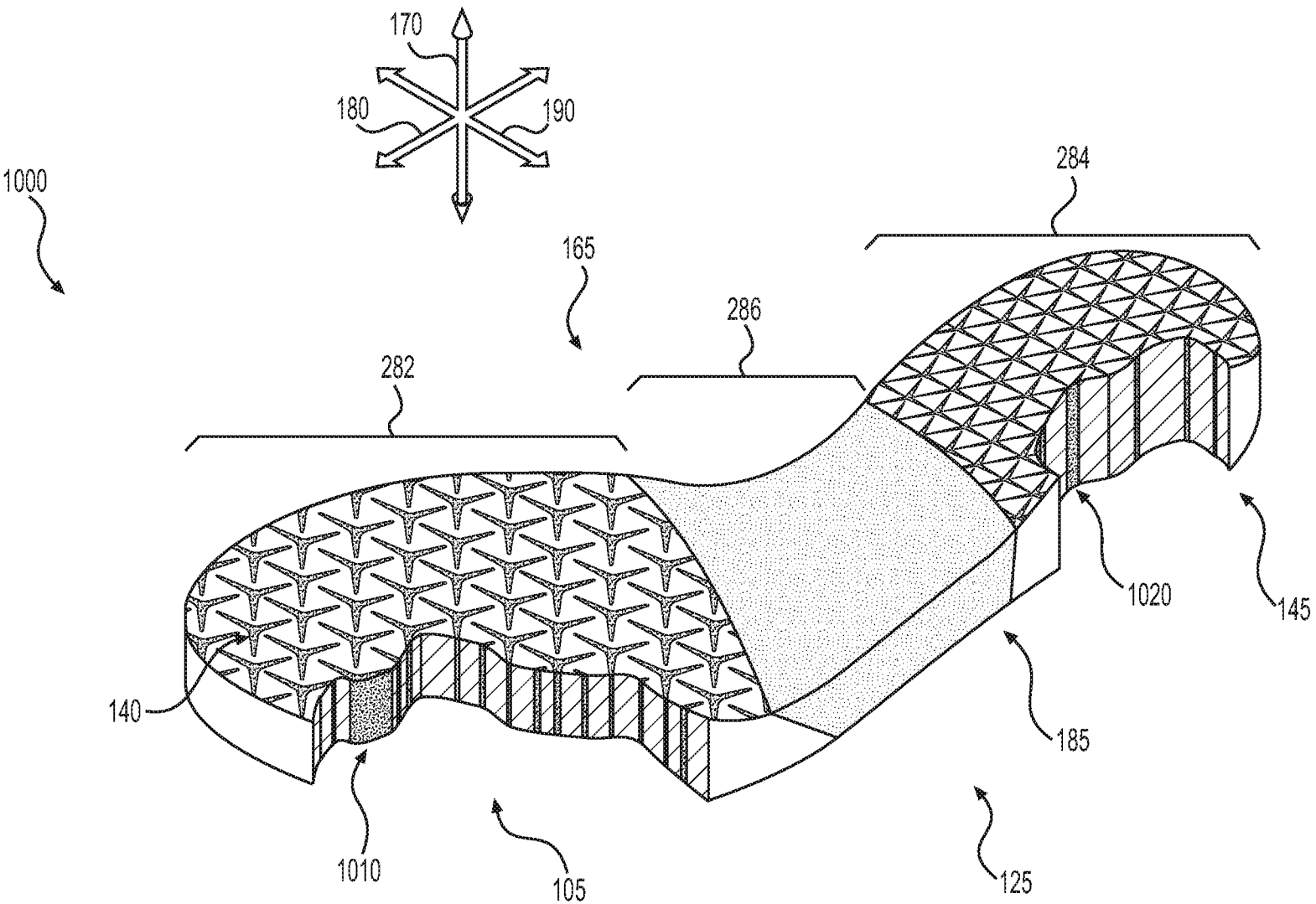
FIG. 10 is an isometric top view of an embodiment of a midsole for an article of footwear.

In FIG. 10, one example of a sole member with apertures that have been "filled in" is illustrated. A second member 1000 is shown with apertures 140 formed in both first auxetic portion 282 and second auxetic portion 284. While both a third set of apertures ("third set") 1010 in first auxetic portion 282 and a fourth set of apertures ("fourth set") 1020 in second auxetic portion 284 comprise through-hole apertures, where an opening of each aperture is formed on both a distal surface and a proximal surface of second member 1000, it can be seen that fourth set 1020 includes apertures that have interior portions of material, as described above with respect to FIG. 9. In other words, while the apertures of third set 1010 remain substantially hollow, the apertures of fourth set 1020 are filled in with a material. In another embodiment, the apertures of third set 1010 can be filled, while the apertures of fourth set 1020 remain hollow. In other embodiments, both the apertures of third set 1010 and the apertures of fourth set 1020 can be filled. The materials comprising the interior portions of each aperture can be substantially similar in some embodiments, or they may differ. For example, in one embodiment where the apertures of third set 1010 and the apertures of fourth set 1020 are filled, the interior portions in third set 1010 can differ from those of fourth set 1020, or may be substantially similar. Furthermore, in some embodiments, specific regions in an auxetic portion may include apertures that are filled, while other apertures in an adjacent region remain hollow. In addition, in some embodiments, specific regions in an auxetic portion may include apertures that are filled with a first material, while other apertures in an adjacent region are filled with a second, different material. It should be understood that while FIG. 10 depicts second member 1000, other embodiments may include a first member configured with interior portions as described herein.

Figure 11:
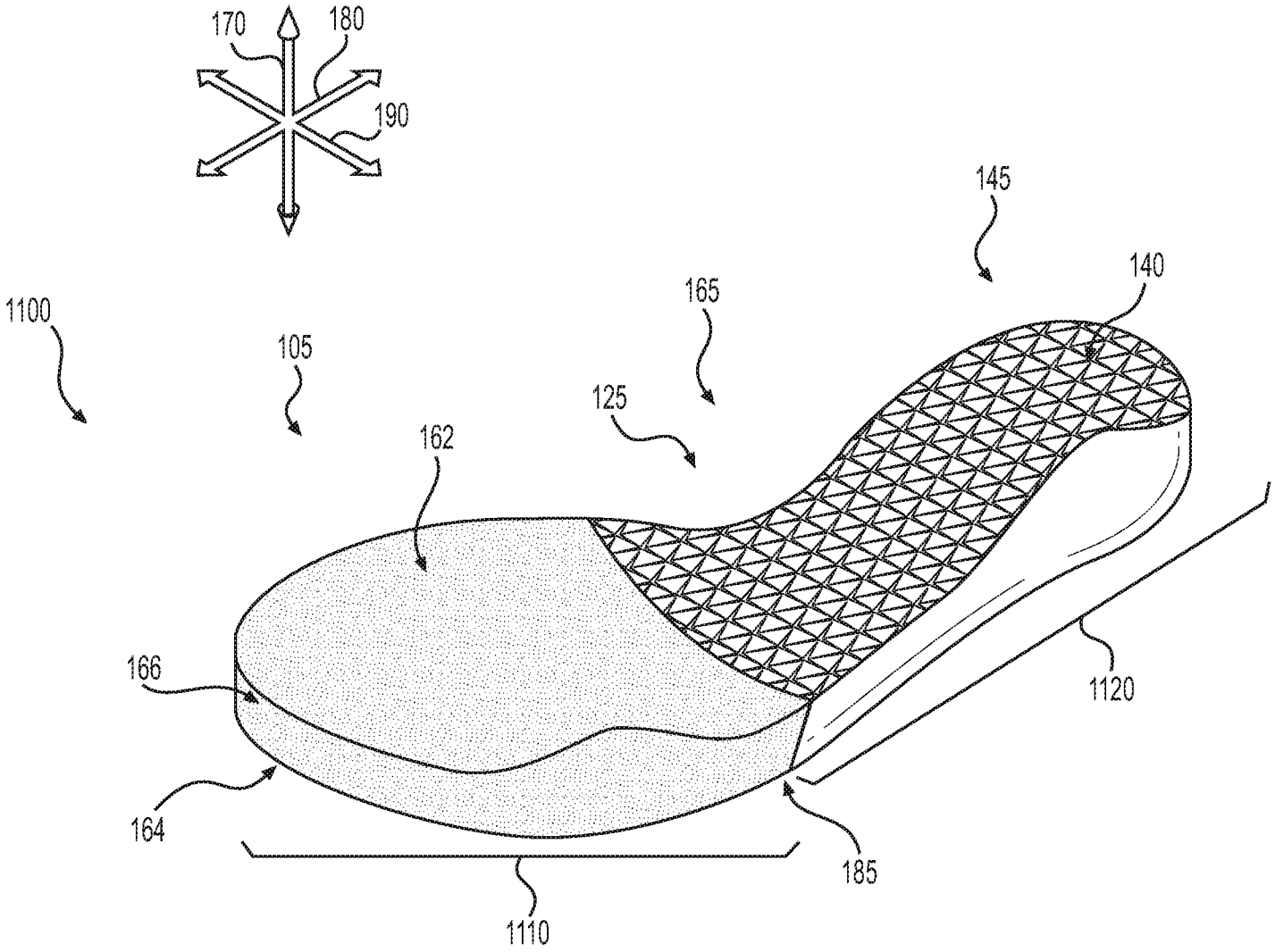
FIG. 11 is an isometric top view of an embodiment of a sole member for an article of footwear.

Furthermore, in different embodiments, a sole structure can include additional variations of configurations described herein. In FIG. 11, a third member 1100 is illustrated in which a forward portion 1110 includes a plate component and a rearward portion 1120 includes an auxetic material. Thus, it can be understood that in some embodiments, a sole member can include a single portion that is configured to behave auxetically, joined to another non-auxetic portion. In other words, the embodiments disclosed herein may comprise only one auxetic portion. In other embodiments, there may be multiple, distinct auxetic portions. In one embodiment, distinct auxetic portions may be interspersed with non-auxetic portions (i.e., portions that are made of non-auxetic materials). For purposes of this description and the claims, a non-auxetic material is a material that contracts in directions orthogonal to the direction of applied tension. In other words, in contrast to auxetic material, a non-auxetic material possesses a positive Poisson's ratio. Thus, for example, a non-auxetic material can become thinner when stretched, or thicker when compressed.

In FIGS. 12-15, for purposes of illustration, a sequence of configurations for portions of the sole members is provided. As noted above with respect to FIGS. 2-4, in some embodiments, the geometry and arrangement of auxetic members 132 may provide auxetic properties to second member 160 when a force is applied. While the discussion below describes the effect on apertures 140 during auxetic expansion, it should be noted that auxetic members 132 may rotate about one or more vertices and their associated hinge portions 134 as a part of this process, such that the rotation of auxetic members 132 can allow differences in aperture size, shape, and angle to occur. Thus, the rotation of auxetic members 132 may at least in part facilitate the changes in second member 160.

Figure 12:
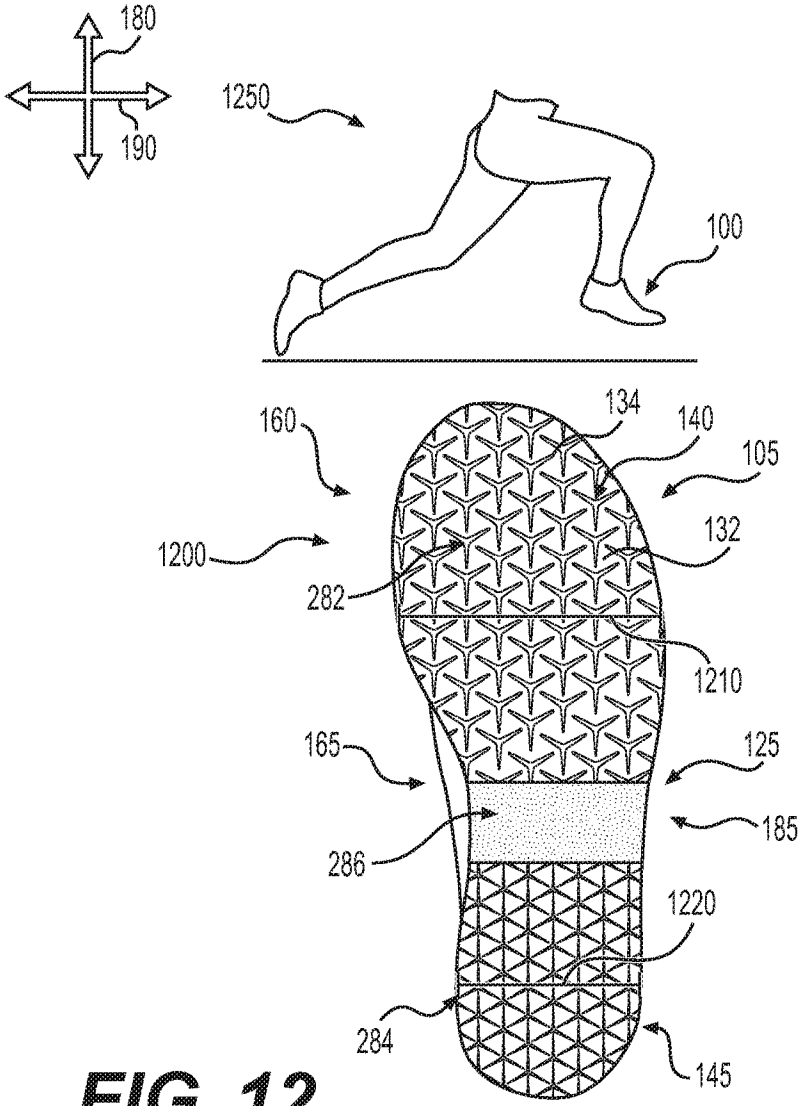
FIG. 12 is a bottom view of an embodiment of a sole member in an article of footwear.

In FIG. 12, a first configuration 1200 is illustrated, where second member 160 is in the neutral state described with respect to FIG. 3. A user 1250 is depicted wearing article 100, which includes second member 160. Article 100 is in mid-air and is thus not experiencing any significant external tension or force. In FIG. 12, first auxetic portion 282 has a first lateral width 1210 and second auxetic portion 284 has a second lateral width 1220.

Figure 13:
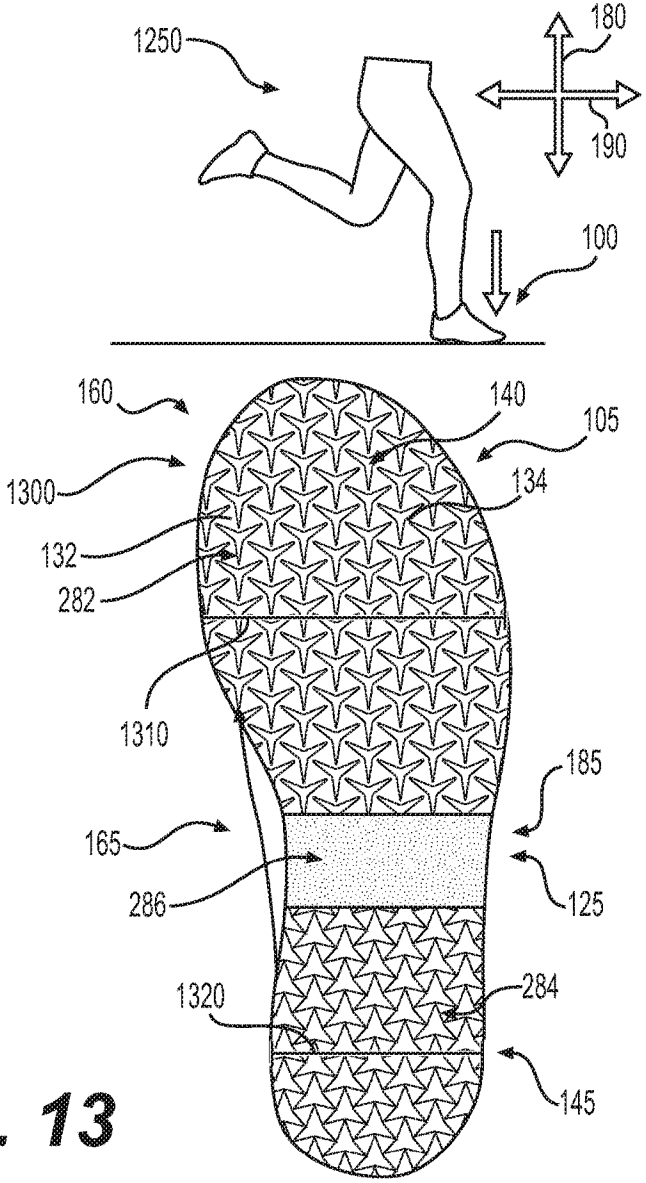
FIG. 13 is a bottom view of an embodiment of a sole member in an article of footwear.

In FIG. 13, user 1250 has impacted the ground with article 100, and second member 160 is being compressed in a second configuration 1300. As tension is applied to second member 160, both first auxetic portion 282 and second auxetic portion 284 can exhibit auxetic behavior. In addition, as noted above with respect to FIG. 4, the type of behavior for each portion can differ. In FIG. 13, first auxetic portion 282 exhibits less "splay" or expansion relative to second auxetic portion 284. In addition, in the expanded state of FIG. 13, first auxetic portion 282 has a third lateral width 1310 that is larger than first lateral width 1210 in FIG. 12, and second auxetic portion 284 has a fourth lateral width 1320 that is larger than second lateral width 1220 in FIG. 12. However, it should be understood that while both portions undergo expansion, second auxetic portion 284 experiences a greater degree of expansion than first auxetic portion 282. This can be due to the smaller widths of hinge portions 134 in some embodiments, and/or the difference in thickness between the portions of the sole member itself. In other embodiments, interior portions can be utilized to adjust or tune the degree or type of expansion, as described above.

Figure 14:
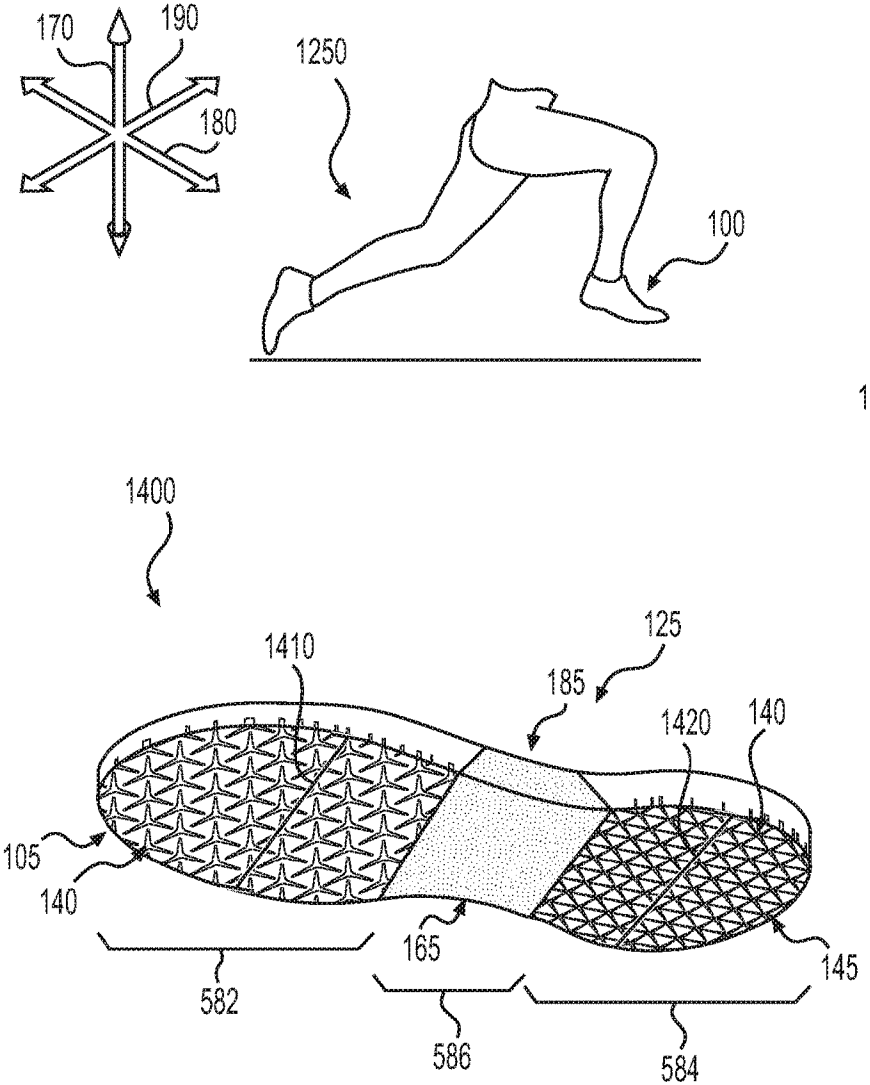
FIG. 14 is an isometric view of an embodiment of a sole member.

In FIG. 14, a third configuration 1400 is illustrated, where first member 150 is in the neutral state. User 1250 is depicted wearing article 100, which includes first member 150. Article 100 is in mid-air and is thus not experiencing any significant external tension or force. In FIG. 14, third auxetic portion 582 has a first lateral width 1410 and fourth auxetic portion 584 has a second lateral width 1420.

Figure 15:
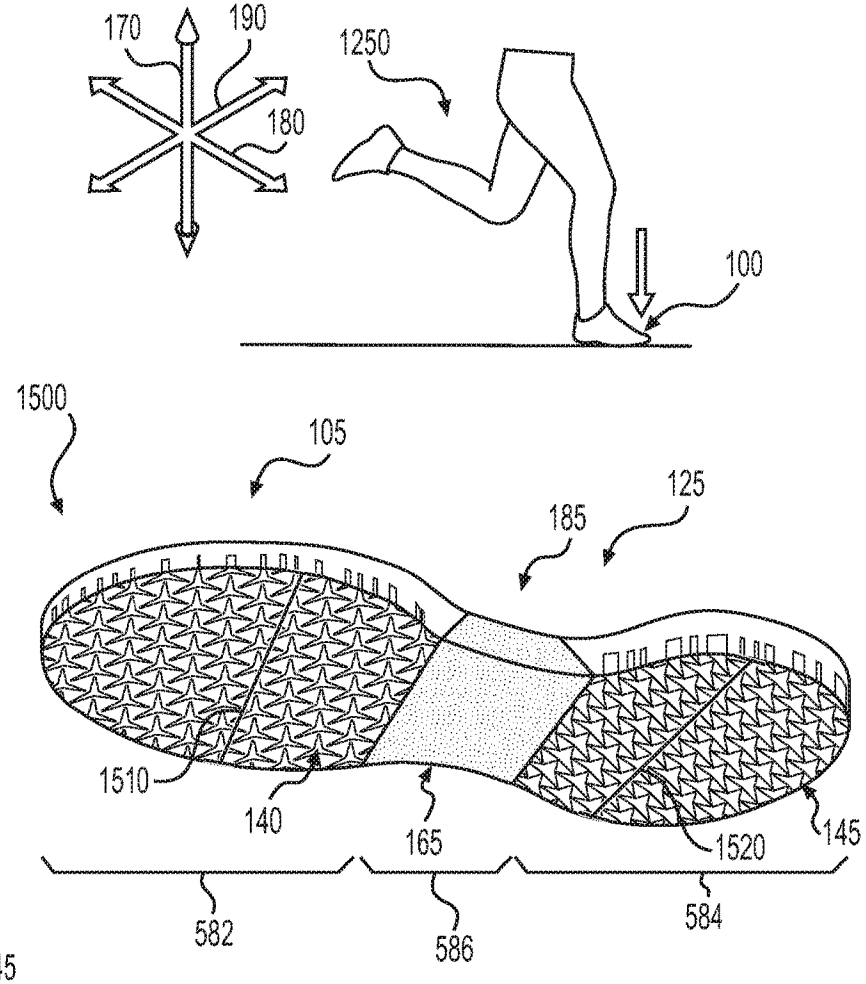
FIG. 15 is an isometric view of an embodiment of a sole member.

In FIG. 15, user 1250 has impacted the ground with article 100, and first member 150 is being compressed in a fourth configuration 1500. As tension is applied to first member 150, both third auxetic portion 582 and fourth auxetic portion 584 can exhibit auxetic behavior. In addition, as noted above with respect to FIG. 4, the type of behavior for each portion can differ. In FIG. 15, third auxetic portion 582 exhibits less "splay" or expansion relative to fourth auxetic portion 584. In addition, in the expanded state of FIG. 15, third auxetic portion 582 has a third lateral width 1510 that is larger than first lateral width 1410 in FIG. 14, and fourth auxetic portion 584 has a fourth lateral width 1520 that is larger than second lateral width 1420 in FIG. 14. However, it should be understood that while both portions undergo expansion, fourth auxetic portion 584 experiences a greater degree of expansion than third auxetic portion 582. This can be due to the smaller thickness of hinge portions 134 in some embodiments, and/or the difference in thickness between the portions of the sole member itself. In other embodiments, interior portions can be utilized to adjust or tune the degree or type of expansion, as described above. Furthermore, it should be understood that different embodiments may tune the auxetic behavior such that forefoot region 105 expands more readily than heel region 145 in either or both of first member 150 or second member 160.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A sole structure, comprising:

an outsole defining an outward, ground contacting surface; and wherein the sole structure includes a forefoot region, a midfoot region, and a heel region;

wherein the heel region has a greater thickness than the forefoot region;

wherein the heel region includes a first subset of auxetic apertures arranged to form a first auxetic structure, each auxetic aperture of the first subset of auxetic apertures extends through the outsole, and the aperture is arranged in a common first orientation relative to the sole structure;

wherein the forefoot region includes a second subset of auxetic apertures arranged to form a second auxetic structure, each auxetic aperture in the second subset of auxetic apertures extends through the outsole, and the aperture is arranged in a common second orientation relative to the sole structure; and wherein the common first orientation of the first subset of auxetic apertures is different than the common second orientation of the second subset of auxetic apertures, and wherein the difference in the common first orientation and the common second orientation causes the forefoot region and the heel region to each have a different auxetic response to a tension applied through the sole structures;

wherein each auxetic aperture of the first subset of auxetic apertures is configured to have a first cross-sectional area when in a neutral, un-tensioned state, each auxetic aperture in the second subset of auxetic apertures is configured to have a second cross-sectional area when in a neutral, un-tensioned state, each of the first and second cross-sectional areas are bounded by a perimeter of the aperture and taken parallel to the outward ground contacting surface of the outsole; and wherein the first cross-sectional area is smaller than the second cross-sectional area.

2. The sole structure according to claim 1, further comprising a midsole coupled to the outsole, wherein each auxetic aperture in the first subset of auxetic apertures extends at least partially into the midsole, each auxetic aperture in the second subset of auxetic apertures extends at least partially into the midsole, the first subset of auxetic apertures include a first aperture, the first aperture has an aperture area in a horizontal plane, and the aperture area changes in response to a compressive force.

3. The sole structure according to claim 1, wherein each auxetic aperture of the sole structure is surrounded by a plurality of auxetic members, wherein each auxetic member is joined to a neighboring auxetic member by a hinge portion, and wherein a first width of a first hinge portion in the forefoot region is greater than a second width of a second hinge portion in the heel region.

4. The sole structure according to claim 2, wherein the first aperture is a through-hole aperture.

5. The sole structure according to claim 2, wherein the first aperture comprises a tri-star shape.

6. The sole structure according to claim 2, wherein the sole structure deforms from a first configuration to a second configuration in response to the applied tension, and wherein the aperture area of the first aperture is larger in the second configuration than in the first configuration.

7. The sole structure of claim 1, wherein the midfoot region is non-auxetic.

8. The sole structure of claim 1, wherein each auxetic aperture of the first subset of auxetic apertures is configured to be substantially closed when in the neutral, un-tensioned state.

9. A sole structure comprising:

a first sole member having an outward surface for contacting a ground surface;

a second sole member, wherein the first sole member is disposed beneath and adjacent to the second sole member such that the outward surface and the second sole member are on opposite sides of the first sole member;

wherein the sole structure includes a forefoot region, a midfoot region, and a heel region;

wherein the heel region includes a first subset of auxetic apertures arranged to form a first auxetic structure, each auxetic aperture in the first subset of auxetic apertures extends through the thickness of the first sole member, and the aperture is arranged in a common first orientation relative to the sole structure wherein the forefoot region includes a second subset of auxetic apertures arranged to form a second auxetic structure, each auxetic aperture in the second subset of auxetic apertures extends through the thickness of the first sole member, and the aperture is arranged in a common second orientation relative to the sole structure;

wherein the common first orientation of the first subset of auxetic apertures is different than the common second orientation of the second subset of auxetic apertures, and wherein the difference in the common first orientation and the common second orientation causes the forefoot region and the heel region to each have a different auxetic response to a tension applied through the sole structure;

wherein each auxetic aperture of the first subset of auxetic apertures is configured to have a first cross-sectional area when in a neutral, un-tensioned state, each auxetic aperture in the second subset of auxetic apertures is configured to have a second cross-sectional area when in a neutral, un-tensioned state, each of the first and second cross-sectional areas are bounded by a perimeter of the aperture and taken parallel to the outward ground contacting surface of the outsole; and wherein the first cross-sectional area is smaller than the second cross-sectional area;

wherein at least one auxetic aperture of the first subset of auxetic apertures is filled with a first material;

wherein the first sole member comprises a second material; and wherein the first material is more elastic than the second material.

10. The sole structure according to claim 9, wherein the first sole member has a greater thickness in the heel region than in the forefoot region, the heel region includes a third subset of auxetic apertures, and each auxetic aperture in the third subset of auxetic apertures extends at least partially through the thickness of the second sole member.

11. The sole member according to claim 10, wherein the auxetic apertures of the third subset of auxetic apertures are arranged in the same orientation as the auxetic apertures of the first subset of auxetic apertures, and each auxetic aperture in the third subset of auxetic apertures is aligned in a vertical direction with a corresponding auxetic aperture in the first subset of auxetic apertures.

12. The sole structure according to claim 9, wherein the forefoot region includes a third subset of auxetic apertures, and each auxetic aperture in the third subset of auxetic apertures extends at least partially through the thickness of the second sole member.

13. The sole member according to claim 12, wherein the third subset of auxetic apertures are arranged in the same orientation as the second subset of auxetic apertures, and each auxetic aperture in the third subset of apertures align in a vertical direction with a corresponding auxetic aperture in the second subset of auxetic apertures.

14. The sole member according to claim 10, wherein the third subset of auxetic apertures are arranged in the same orientation as the first subset of auxetic apertures.

15. The sole member according to claim 11, wherein each auxetic aperture of the third subset of auxetic apertures is a through-hole aperture.

16. The sole structure according to claim 9, wherein each auxetic aperture of the sole structure is surrounded by a plurality of auxetic members, each auxetic member is joined to a neighboring auxetic member by a hinge portion, and a first width of a first hinge portion in the forefoot region is greater than a second width of a second hinge portion in the heel region.

17. The sole structure of claim 9, wherein the midfoot region is non-auxetic.

18. The sole structure of claim 9, wherein each auxetic aperture of the first subset of auxetic apertures is configured to be substantially closed when in the neutral, un-tensioned state.

* * * * *